US010815560B2

(12) United States Patent
Miyamoto

(10) Patent No.: US 10,815,560 B2
(45) Date of Patent: Oct. 27, 2020

(54) SPRAYING POWDER AND METHOD FOR DEPOSITING SPRAYED COATING USING THE SAME

(71) Applicant: TOYOTA JIDOSHA KABUSHIKI KAISHA, Toyota (JP)

(72) Inventor: Noritaka Miyamoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 15 days.

(21) Appl. No.: 15/950,530

(22) Filed: Apr. 11, 2018

(65) Prior Publication Data

US 2018/0298480 A1 Oct. 18, 2018

(30) Foreign Application Priority Data

Apr. 13, 2017 (JP) ..... 2017-079395

(51) Int. Cl.

| | |
|---|---|
| ***C23C 4/067*** | (2016.01) |
| ***C22C 19/05*** | (2006.01) |
| ***C23C 4/06*** | (2016.01) |
| ***C23C 4/129*** | (2016.01) |

(52) U.S. Cl.

CPC ..... *C23C 4/067* (2016.01); *C22C 19/058* (2013.01); *C23C 4/06* (2013.01); *C23C 4/129* (2016.01)

(58) Field of Classification Search

CPC .... C23C 4/067; C23C 4/12906; C22C 19/058
USPC ..... 428/548
See application file for complete search history.

(56) References Cited

U.S. PATENT DOCUMENTS

| | | | | |
|---|---|---|---|---|
| 3,655,425 | A | 4/1972 | Longo et al. | |
| 5,536,022 | A * | 7/1996 | Sileo | C23C 4/02 277/415 |
| 2007/0216107 | A1 | 9/2007 | Freling | |
| 2007/0248457 | A1 | 10/2007 | Dodd et al. | |
| 2012/0295825 | A1* | 11/2012 | Dorfman | C23C 4/04 508/151 |

FOREIGN PATENT DOCUMENTS

| | | | |
|---|---|---|---|
| CN | 104087789 A * | 10/2014 | |
| CN | 104087789 B * | 9/2016 | |
| EP | 1801248 B1 * | 10/2010 | C04B 38/067 |

(Continued)

OTHER PUBLICATIONS

Liu et al., CN 104087789 B, machine translation, Sep. 2016, entire translation (Year: 2016).*

(Continued)

*Primary Examiner* — Humera N. Sheikh
*Assistant Examiner* — Katherine A Christy
(74) *Attorney, Agent, or Firm* — Sughrue Mion, PLLC

(57) ABSTRACT

Provided are spraying powder that can suppress a decrease in the machinability of the resulting sprayed coating even under a high-temperature environment, and a method for depositing a sprayed coating using the same. The spraying powder is spraying powder for depositing a sprayed coating with an abradable property. The spraying powder includes NiCr-based alloy particles and h-BN particles. A NiCr-based alloy of the NiCr-based alloy particles contains 2 to 10 mass % of Si, and the content of the h-BN particles in the spraying powder is 4 to 8 mass %.

1 Claim, 22 Drawing Sheets

(56) References Cited

FOREIGN PATENT DOCUMENTS

| | | | | |
|---|---|---|---|---|
| JP | 50-16811 | A | | 6/1975 |
| JP | 2133538 | A | * | 5/1990 |
| JP | 04-325668 | A | | 11/1992 |
| JP | 11-047980 | A | | 2/1999 |
| JP | 2007-247063 | A | | 9/2007 |
| JP | 2008-111425 | A | | 5/2008 |
| JP | 2013-518182 | A | | 5/2013 |

OTHER PUBLICATIONS

Masao. JP 2133538 A, May 22, 1990, entire translation (Year: 1990).*

Chen, CN 104087789 A machine translation, Oct. 2014, entire machine translation (Year: 2014).*

* cited by examiner

| | Photograph of powder | Enlarged photograph |
|---|---|---|
| Example 1 |   |   |
| Example 2 |   |   |

| | Photograph of powder | Enlarged photograph |
|---|---|---|
| Comparative example 1 |   |   |
| Comparative example 2 |   |   |
| Comparative example 3 |   |   |

SPRAYING POWDER AND METHOD FOR DEPOSITING SPRAYED COATING USING THE SAME

CROSS REFERENCE TO RELATED APPLICATIONS

The present application claims priority from Japanese patent application JP 2017-079395 filed on Apr. 13, 2017, the content of which is hereby incorporated by reference into this application.

BACKGROUND

Technical Field

The present disclosure relates to spraying powder suitable for depositing a sprayed coating with an abradable property and a method for depositing a sprayed coating using the same.

Background Art

Conventionally, to form sprayed coatings with an abradable property (abradable sprayed coatings), materials meeting given specifications have been used on the basis of the standards for aircraft engines and the like. The "abradable property" as referred to herein is a property of abrading the own member to protect a counterpart member. In recent years, for example, abradable sprayed coatings with heat resistance, for example, a heatproof temperature of greater than 500° C. have been developed for gas turbines and jet engines.

As such spraying powder, for example, JP2007-247063A proposes spraying powder that includes a hard carbide material containing about 30 to 80 weight % of nickel chrome and also includes a lubricating material containing about 20 to 70 weight % of boron nitride to be mixed in the hard carbide material. With such spraying powder, the abradable property of the resulting sprayed coating can be enhanced by means of the lubricating material containing boron nitride.

SUMMARY

However, even when a sprayed coating is deposited using the spraying powder described in JP2007-247063A, the machinability of the sprayed coating may become significantly low under a high-temperature environment of about 800° C., for example, although the machinability of the sprayed coating is excellent at the room temperature.

Accordingly, exemplary embodiments of the present disclosure relate to providing spraying powder that can suppress a decrease in the machinability of the resulting sprayed coating even under a high-temperature environment, and a method for depositing a sprayed coating using the same.

Accordingly, the spraying powder in accordance with the present disclosure is spraying powder for depositing a sprayed coating with an abradable property, including NiCr-based alloy particles and h-BN particles. A NiCr-based alloy of the NiCr-based alloy particles contains 2 to 10 mass % of Si, and the content of the h-BN particles in the spraying powder is 4 to 8 mass %.

According to the present disclosure, with the NiCr-based alloy of the NiCr-based alloy particles allowed to contain 2 to 10 mass % of Si, oxide layers of $SiO_2$ can be formed on the surfaces of the NiCr-based alloy particles that form the resulting sprayed coating.

The oxide layers of $SiO_2$ have high wettability with respect to the h-BN particles during spraying. Therefore, if the h-BN particles are contained at 4 to 8 mass % in the spraying powder, the h-BN particles are allowed to be present in a greater amount between the NiCr-based alloy particles of the resulting sprayed coating in comparison with that in the conventional powder.

Consequently, the adhesive wear of the NiCr-based alloy particles of the sprayed coating can be suppressed by means of the h-BN particles with solid lubricity even at high temperatures, and therefore, a decrease in the machinability of the sprayed coating can be suppressed. The grounds for the content of Si and the content of h-BN particles are described in the following embodiments.

DETAILED DESCRIPTION

Hereinafter, an embodiment of the present disclosure will be described with reference to FIG. 1.

1. Regarding Spraying Powder 10

Figure 1:
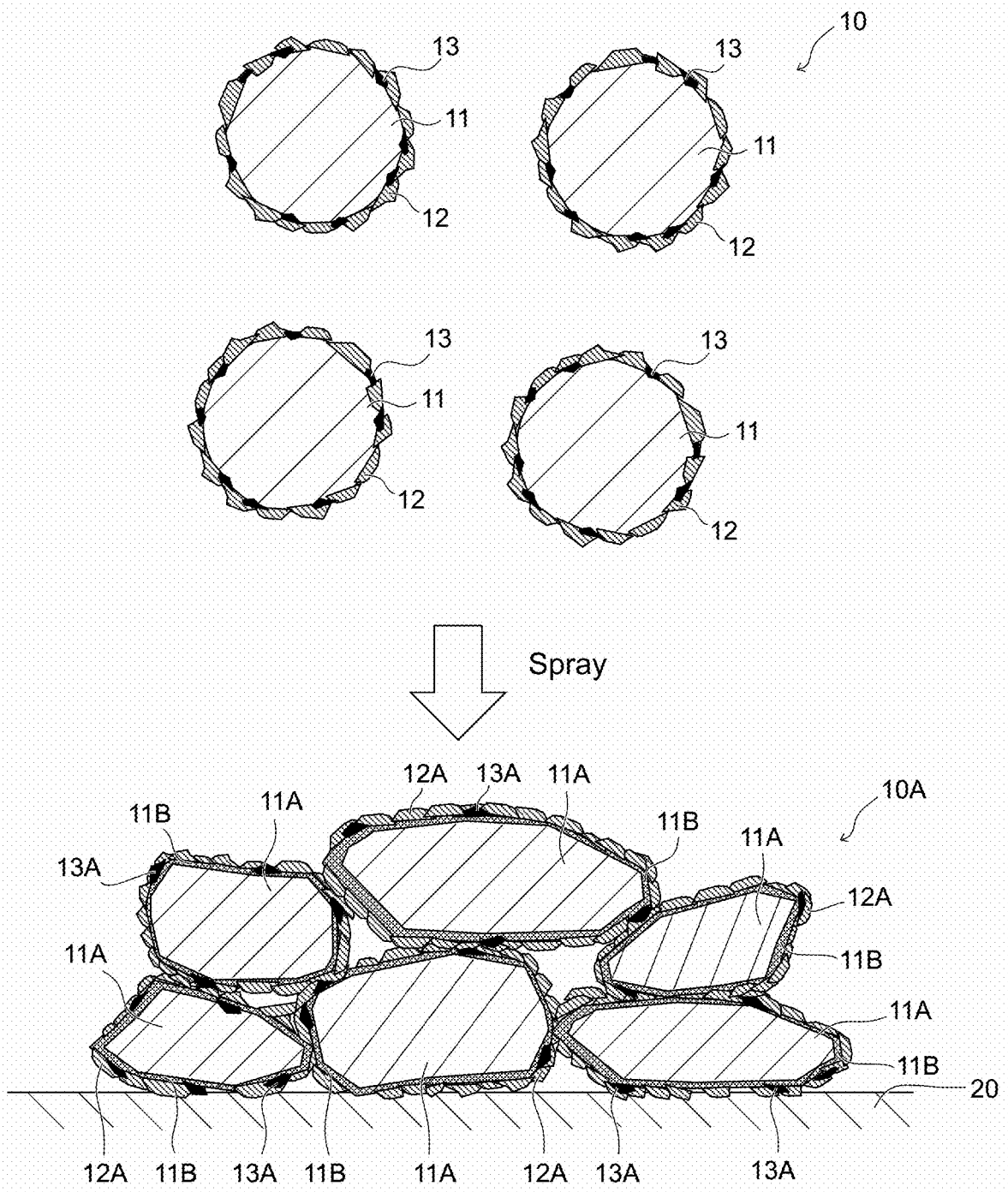
FIG. 1 is a schematic cross-sectional view of spraying powder in accordance with an embodiment of the present disclosure and a part of a sprayed coating that is deposited using the spraying powder.

FIG. 1 is a schematic conceptual view of spraying powder 10 in accordance with an embodiment of the present disclosure and a sprayed coating 10A that is deposited using the spraying powder 10.

As shown in FIG. 1, the spraying powder 10 in this embodiment is spraying powder for depositing a sprayed coating with an abradable property (hereinafter simply referred to as a "sprayed coating"). The spraying powder 10 is powder containing NiCr-based alloy particles 11 and h-BN particles 12, and further containing Al particles 13 as appropriate. In this embodiment, the spraying powder 10 is powder of particles obtained by mixing powder of NiCr-based alloy particles 11 with powder of h-BN particles 12, and granulating them with a binder such as resin.

The spraying powder 10 may also be just powder of a mixture of the NiCr-based alloy particles 11 and the h-BN particles 12 as long as the NiCr-based alloy particles 11 and the h-BN particles 12 can be sprayed in a mixed state onto a substrate 20 when the spraying powder 10 is sprayed. Alternatively, the spraying powder 10 may be powder obtained through compaction, such as cladding, instead of the granulated powder obtained through granulation of the NiCr-based alloy particles 11 and the h-BN particles 12. It should be noted that as shown in FIG. 1, as the spraying powder 10, the entire surfaces of the NiCr-based alloy particles 11 are preferably covered with the h-BN particles 12.

1-1. Regarding NiCr-Based Alloy Particles 11

The NiCr-based alloy particles 11 are particles of a NiCr-based alloy. The NiCr-based alloy particles 11 preferably contain Cr in the range of 7 to 25 mass % relative to the entire mass of the particles (that is, the NiCr alloy), though the content of Cr is not particularly limited. Accordingly, the oxidation resistance of the NiCr-based alloy particles 11 can be enhanced. Herein, if the content of Cr is less than 7 mass %, the oxidation resistance of the NiCr-based alloy may possibly be lost. Meanwhile, if the content of Cr is greater than 25 mass %, the NiCr-based alloy becomes too hard, and thus the machinability of the resulting sprayed coating 10A may possibly become lower.

In this embodiment, a NiCr-based alloy that forms the NiCr-based alloy particles 11 contains 2 to 10 mass % of Si (silicon) relative to the entire NiCr-based alloy. Accordingly, oxide layers 11B of $SiO_2$ (silicon dioxide) can be formed on the surfaces of the NiCr-based alloy particles 11A forming the sprayed coating 10A. The oxide layers 11B have high wettability with respect to the h-BN particles 12A. Therefore, more h-BN particles 12A are allowed to be present between the NiCr-based alloy particles 11A of the sprayed coating 10A.

Herein, if the content of Si relative to the entire NiCr-based alloy is less than 2 mass %, the oxide layers 11B of $SiO_2$ (silicon dioxide) with sufficient thickness cannot be formed on the surfaces of the NiCr-based alloy particles 11A. Accordingly, wettability with respect to the h-BN particles 12 would decrease, and thus the h-BN particles 12A are not allowed to be present in a sufficient amount between the NiCr-based alloy particles 11A of the sprayed coating 10A. Meanwhile, if the content of Si relative to the entire NiCr-based alloy is greater than 10 mass %, the NiCr-based alloy may become brittle.

The NiCr-based alloy of the NiCr-based alloy particles 11 may further contain less than or equal to 4 mass % of B (boron) relative to the entire NiCr-based alloy. Accordingly, the oxide layers 11B containing a mixture of $SiO_2$ and $B_2O_3$ (boron oxide) can be formed on the surfaces of the NiCr-based alloy particles 11A forming the sprayed coating 10A. As the oxide layers 11B contain $B_2O_3$, the wettability of the oxide layers 11B with respect to the h-BN particles 12A can be further enhanced. Accordingly, more h-BN particles 12A are allowed to be present between the NiCr-based alloy particles 11A of the sprayed coating 10A.

Further, the content of each of Si and B is preferably adjusted so that the NiCr-based alloy of the NiCr-based alloy particles has a melting point of 940 to 1200° C. If the melting point of the NiCr-based alloy satisfies such a range, it is possible to, in spraying, form the oxide layers 11B of Si and B on the NiCr-based alloy particles 11A of the sprayed coating 10A while easily allowing more h-BN particles 12A to be present between the NiCr-based alloy particles 11A of the sprayed coating 10A.

Herein, if the melting point of the NiCr-based alloy is less than 940° C., the NiCr-based alloy itself is likely to be oxidized and the NiCr-based alloy particles of the resulting sprayed coating become soft under a high-temperature environment. Therefore, the sprayed coating is likely to wear adhesively. Meanwhile, if the melting point of the NiCr-based alloy is greater than 1200° C., the NiCr-based alloy particles of the resulting sprayed coating are difficult to melt.

Therefore, the sticking efficiency of the spraying powder with respect to a substrate would decrease.

The particle size of the NiCr-based alloy particles 11 is not particularly limited as long as a sprayed coating with properties described below can be deposited. However, the particle size of the NiCr-based alloy particles 11 is preferably in the range of 38 to 150 μm, or more preferably in the range of 45 to 125 μm, for example.

It should be noted that the "particle size" as referred to herein is a particle size measured through laser diffraction particle size distribution measurement. Such a particle size can be obtained through classification in accordance with JIS Z 2510, for example. It should also be noted that the entire surfaces of the NiCr-based alloy particles 11 are preferably covered with the h-BN particles 12, and in such a case, the particle size of the h-BN particles 12 is smaller than that of the NiCr-based alloy particles 11.

1-2. Regarding h-BN Particles 12

The spraying powder 10 shown in FIG. 1 contains the h-BN particles 12. The h-BN particles 12 are particles of hexagonal boron nitride. In this embodiment, as a preferred aspect, the h-BN particles 12 cover the entire surfaces of the NiCr-based alloy particles 11. The spraying powder 10 contains the h-BN particles 12 at 4 to 8 mass % relative to the entire spraying powder 10. Since h-BN is a material with solid lubricity like graphite, if the h-BN particles 12 are contained in such a range, it is possible to suppress the adhesive wear of the resulting sprayed coating 10A and further enhance the abradable property.

Herein, if the content of the h-BN particles 12 relative to the entire spraying powder 10 is less than 4 mass %, the solid lubricity of h-BN cannot be fully exhibited, and thus the resulting sprayed coating 10A becomes likely to wear adhesively. In addition, since the amount of the h-BN particles 12A that are allowed to be present between the NiCr-based alloy particles 11A of the sprayed coating 10A becomes smaller, metallic bonds between the NiCr-based alloy particles 11A will increase, which in turn may increase the hardness of the sprayed coating 10A and thus lower the machinability of the sprayed coating 10A. Meanwhile, if the content of the h-BN particles 12 relative to the entire spraying powder 10 is greater than 8 mass %, the resulting sprayed coating 10A becomes brittle due to the increased amount of the h-BN particles 12. When such a sprayed coating 10A is applied to a turbine blade, for example, erosion wear of the sprayed coating 10A may occur or the sprayed coating 10A may partially come off due to a gas stream.

The particle size of the h-BN particles 12A of the spraying powder 10 is not particularly limited as long as the sprayed coating 10A with properties described below can be deposited. However, in order to more uniformly cover the entire surfaces of the NiCr-based alloy particles 11 with the aforementioned content of h-BN particles 12, the particle size of the h-BN particles 12 is preferably in the range of 3 to 30 μm, and more preferably in the range of 3 to 10 μm.

1-3. Regarding Al Particles 13

The spraying powder 10 shown in FIG. 1 may further contain the Al particles 13. The Al particles 13 are particles of aluminum, and the spraying powder 10 preferably contains 3 to 5 mass % of the Al particles 13 relative to the entire spraying powder 10. Since Al has high wettability with respect to NiCr-based alloy particles and h-BN particles, if the spraying powder 10 contains the Al particles 13 in such a range, it is possible to suppress the separation between the NiCr-based alloy particles 11 and the h-BN particles 12 during deposition of a coating.

Herein, if the content of the Al particles 13 relative to the entire spraying powder 10 is less than 3 mass %, it would be impossible to fully expect the advantageous effects of the wettability of the Al particles 13A with respect to the NiCr-based alloy particles 11A and the h-BN particles 12A in the resulting sprayed coating 10A. Meanwhile, if the content of the Al particles 13 relative to the entire spraying powder 10 is greater than 5 mass %, the machinability of the resulting sprayed coating 10A would decrease.

In this embodiment, when the spraying powder 10 is granulated, the Al particles 13 are bound to the NiCr-based alloy particles 11 and the h-BN particles 12 via binders. The spraying powder 10 may be just powder of a mixture of the NiCr-based alloy particles 11, the h-BN particles 12, and the Al particles 13 as long as the NiCr-based alloy particles 11 and the h-BN particles 12 as well as the Al particles 13 can be sprayed in a uniformly mixed state onto the substrate 20 when the spraying powder 10 is sprayed. Alternatively, the spraying powder 10 may be powder formed through compaction, such as cladding, instead of the granulated powder obtained through granulation of the NiCr-based alloy particles 11, the h-BN particles 12, and the Al particles 13. The particle size of the Al particles 13 is not particularly limited as long as a sprayed coating with properties described below can be deposited. However, the particle size of the Al particles 13 is preferably in the range of 3 to 30 μm, for example.

2. Regarding Method for Depositing Sprayed Coating 10A

In this embodiment, the spraying powder 10 shown in FIG. 1 is put into a spraying apparatus (not shown), and with the spraying powder 10, the sprayed coating 10A is deposited on the surface of the substrate 20, such as a turbo housing of a turbocharger.

The spraying method is not particularly limited as long as the sprayed coating 10A can be deposited. As a preferable spraying method, gas flame spraying is used that can spray the spraying powder 10 to the substrate 20 at a lower temperature than that when other spraying methods, such as plasma spraying, are used. When the spraying powder 10 is sprayed using gas flame spraying, it is possible to, during deposition of a coating, allow more h-BN particles 12A to be present between the NiCr-based alloy particles 11A so that the h-BN particles 12A cover the NiCr-based alloy particles 11A. Accordingly, metallic bonds between the NiCr-based alloy particles 11A can be reduced, and thus the machinability of the resulting sprayed coating 10A can be enhanced.

Herein, when a counterpart member (for example, a turbine wheel blade) contacts a sprayed member obtained through deposition of the sprayed coating 10A on the substrate (for example, a turbo housing of a turbocharger), the sprayed coating 10A is worn away by the counterpart member.

As described above, in this embodiment, the NiCr-based alloy of the NiCr-based alloy particles 11 is allowed to contain 2 to 10 mass % of Si, whereby the oxide layers 11B of $SiO_2$ can be formed on the surfaces of the NiCr-based alloy particles 11A forming the sprayed coating 10A.

The oxide layers 11B of $SiO_2$ have high wettability with respect to the h-BN particles 12A during spraying. Therefore, if the h-BN particles 12 are contained at 4 to 8 mass % in the spraying powder 10, the h-BN particles 12A are allowed to be present in a greater amount between the NiCr-based alloy particles 11A,11A of the resulting sprayed coating 10A in comparison with that in the conventional powder.

Consequently, the adhesive wear of the NiCr-based alloy particles 11A of the sprayed coating 10A can be suppressed by means of the h-BN particles 12A with solid lubricity even at high temperatures, and therefore, a decrease in the machinability of the sprayed coating 10A can be suppressed.

EXAMPLES

Hereinafter, the present disclosure will be described with reference to Examples.

Example 1

Figure 2:
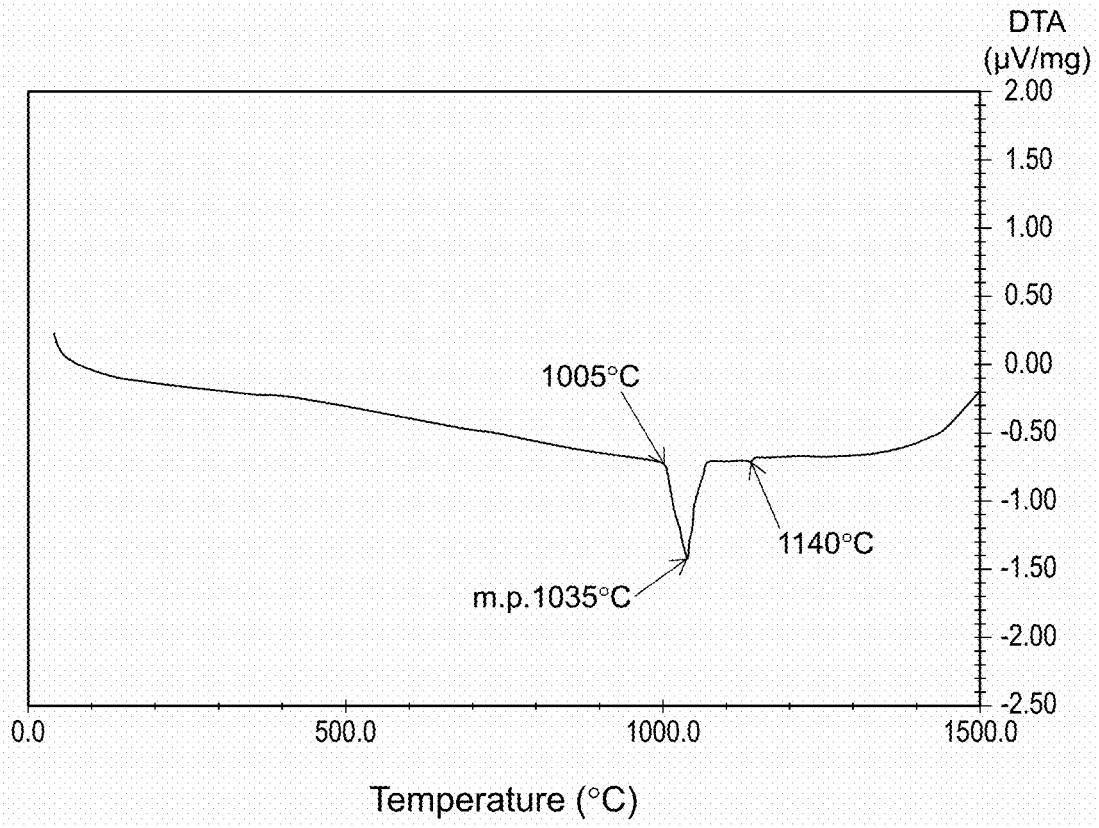
FIG. 2 shows a graph of the results of measuring the melting point of NiCr-based alloy particles of the spraying powder of Example 1 using a differential thermogravimetric analysis apparatus.

NiCr-based alloy particles of gas-atomized powder were prepared. A NiCr-based alloy of the NiCr-based alloy particles contains, as shown in Table 1, 82.5 mass % of Ni, 10 mass % of Cr, 2.5 mass % of silicon, 3 mass % of boron, and 2 mass % of iron. The melting point of the powder was measured with a differential thermogravimetric analysis apparatus (TG-DTA apparatus). The results are shown in FIG. 2 and Table 1. FIG. 2 is a graph of the results of measuring the melting point of the NiCr-based alloy particles of the spraying powder of Example 1 using a differential thermogravimetric analysis apparatus. As shown in FIG. 2, the melting point of the NiCr-based alloy particles is 1035° C.

TABLE 1

| | NiCr-based alloy particles | | | | | | h-BN | Al |
|---|---|---|---|---|---|---|---|---|
| | Components (mass %) | | | | | Melting Point | Particles | Particles |
| | Ni | Cr | Si | B | Fe | (° C.) | (mass %) | (mass %) |
| Example 1 | 82.5 | 10 | 2.5 | 3 | 2.0 | 1035 | 5.5 | 4.0 |
| Example 2 | 71 | 19 | 10 | — | — | 1109 | 5.5 | 4.0 |
| Comparative Example 1 | 80 | 20 | — | — | — | 1413 | 5.5 | 4.0 |
| Comparative Example 2 | 80 | 20 | — | — | — | 1413 | 5.5 | 4.0 |
| Comparative Example 3 | 75 | 16 | — | — | 9.0 | 1418 | 6.5 | 3.5 |

Figure 3A:
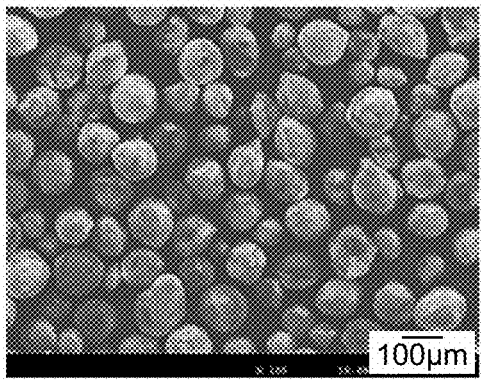
FIG. 3A shows photographs of the spraying powder of Examples 1 and 2.
Figure 3A:
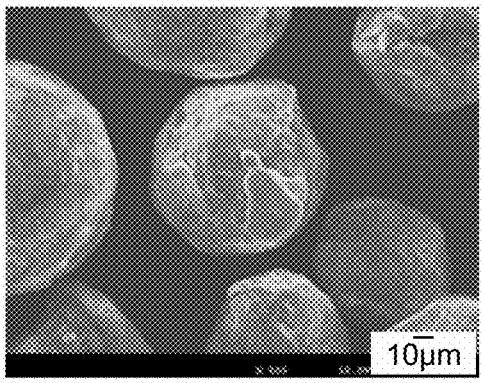
Figure 3A:
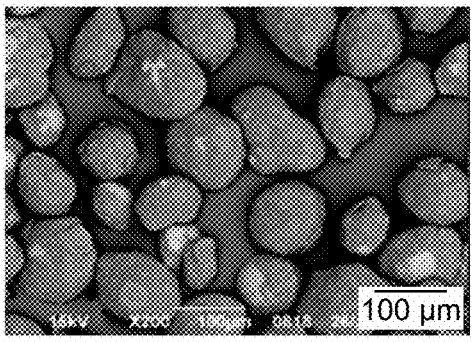
Figure 3A:
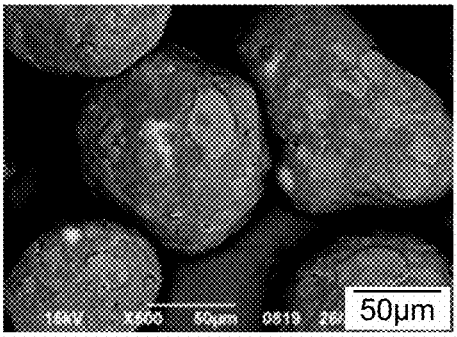

Next, h-BN particles with a particle size of 3 to 10 μm and Al particles with a particle size of less than or equal to 20 μm were prepared and mixed such that the resulting spraying powder contained 5.5 mass % of h-BN particles, 4.0 mass % of Al particles, and a balance of NiCr-based alloy particles. Then, the h-BN particles and Al particles were bonded to the peripheries of the NiCr-based alloy particles via binder resin so that spraying powder was produced through granulation. The obtained spraying powder was observed with a scanning electron microscope (SEM). The results are shown in FIG. 3A.

Figure 4:
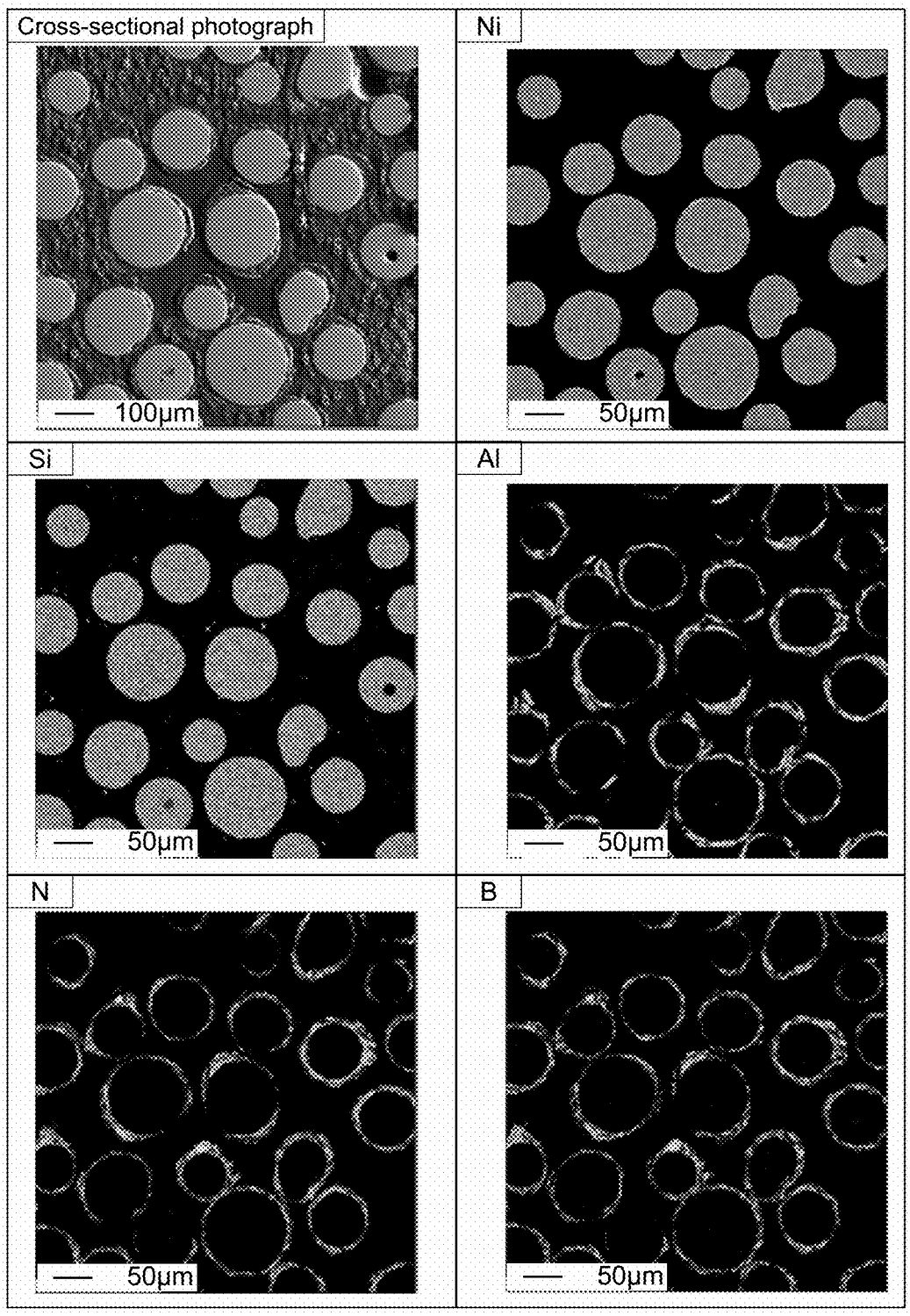
FIG. 4 shows a cross-sectional photograph of the spraying powder of Example 1 and photographs of the distributions of Ni, Si, Al, N, and B in the cross-sectional photographs.

Next, the spraying powder of Example 1 was buried in resin and the resin was cut so that elements in the exposed cross-section of the spraying powder were measured through EPMA analysis. The results are shown in FIG. 4. FIG. 4 shows a cross-sectional photograph of the spraying powder of Example 1 and photographs of the distributions of Ni, Si, Al, N, and B in the cross-sectional photographs. As shown in FIGS. 4 and 3A, it is found that the entire surfaces of the NiCr-based alloy particles are uniformly covered with the h-BN particles.

Next, using the spraying powder of Example 1, a sprayed coating was deposited on the surface of a substrate so as to produce a sprayed test piece. Specifically, the spraying powder was sprayed to the surface of a substrate (nickel alloy (Inconel 600)) with a width of 25 mm, a length of 50 mm, and a thickness of 6 mm using a gas flame spraying apparatus. The pressure of gas supplied to a thermal spraying gun was set as follows: oxygen gas: 32 psi, hydrogen gas (fuel gas): 28 psi, and air: 60 psi, and the flow rate of the gas supplied was set as follows: oxygen gas: 32 NLPM, hydrogen gas: 155.8 NLPM, and air: 102.3 NLPM. The feed rate of the spraying powder fed to the thermal spraying gun during deposition was set to 90 g/minute, the distance from the tip end of the thermal spraying gun to the substrate was set to 230 mm, the traveling speed of the thermal spraying gun was set to 30 m/minute, and the pitch was set to 6 mm.

Example 2

NiCr-based alloy particles of gas-atomized powder were prepared. A NiCr-based alloy of the NiCr-based alloy particles contains, as shown in Table 1, 71 mass % of Ni, 19 mass % of Cr, and 10 mass % of Si. The melting point of the powder was measured with a differential thermogravimetric analysis apparatus as in Example 1. The results are shown in Table 1.

Next, as in Example 1, h-BN particles and Al particles at the same proportions as those in Example 1 were bonded to the peripheries of the NiCr-based alloy particles via binder resin so that spraying powder was produced through granulation. The spraying powder was observed with a SEM. The results are shown in FIG. 3A. Using the spraying powder, a sprayed coating was deposited on the surface of a substrate under the same conditions as those in Example 1 so as to produce a sprayed test piece.

Comparative Example 1

NiCr-based alloy particles of gas-atomized powder with a particle size of 38 μm to 150 μm were prepared. A NiCr-based alloy of the NiCr-based alloy particles contains, as shown in Table 1, 80 mass % of Ni and 20 mass % of Cr and does not contain silicon or the like. The melting point of the powder was measured with a differential thermogravimetric analysis apparatus as in Example 1. The results are shown in Table 1.

Figure 3B:
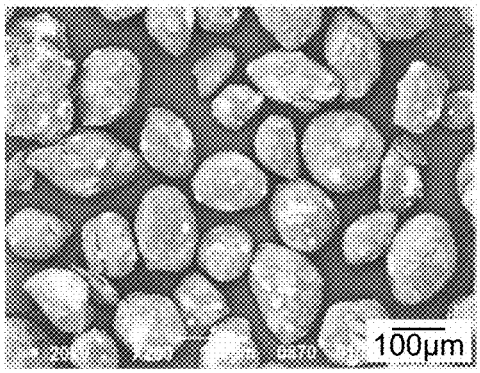
FIG. 3B shows photographs of the spraying powder of Comparative Examples 1 to 3.
Figure 3B:
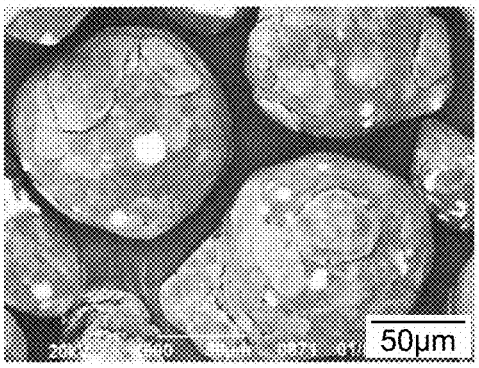
Figure 3B:
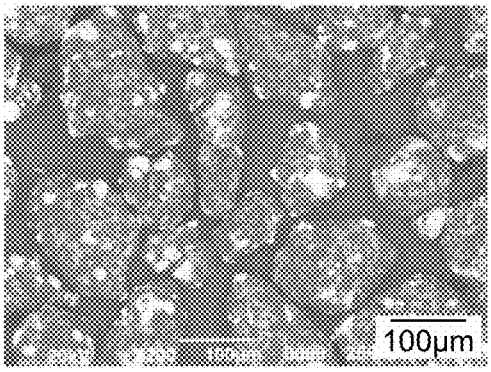
Figure 3B:
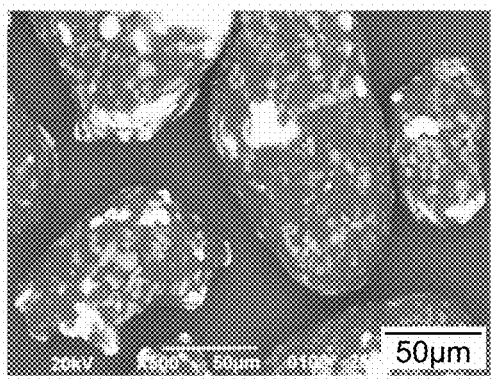
Figure 3B:
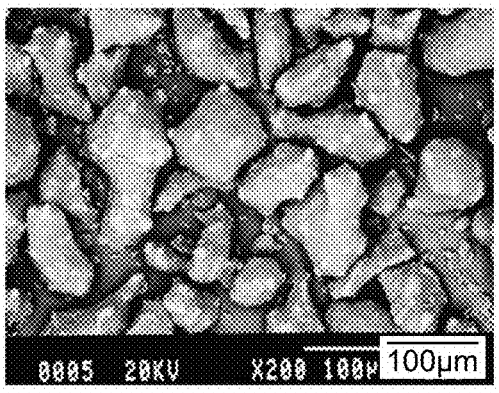
Figure 3B:
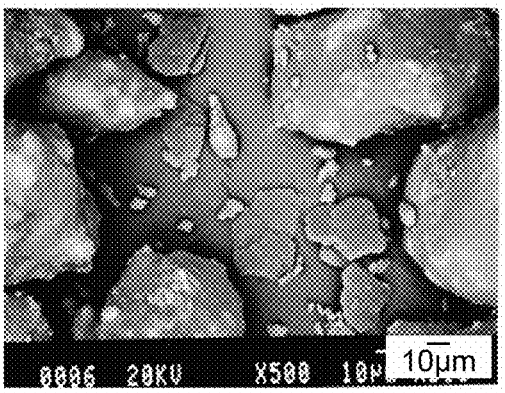

Next, as in Example 1, h-BN particles and Al particles at the same proportions as those in Example 1 were bonded to the peripheries of the NiCr-based alloy particles via binder resin so that spraying powder was produced through granulation. The spraying powder was observed with a SEM. The results are shown in FIG. 3B. Using the spraying powder, a sprayed coating was deposited on the surface of a substrate under the same conditions as those in Example 1 so as to produce a sprayed test piece.

Comparative Example 2

NiCr-based alloy particles of water-atomized powder with a particle size of 38 μm to 150 μm were prepared. A NiCr-based alloy of the NiCr-based alloy particles contains, as shown in Table 1, 80 mass % of Ni and 20 mass % of Cr and does not contain silicon or the like. The melting point of the powder was measured with a differential thermogravimetric analysis apparatus as in Example 1. The results are shown in Table 1.

Next, as in Example 1, h-BN particles and Al particles at the same proportions as those in Example 1 were bonded to the peripheries of the NiCr-based alloy particles via binder resin so that spraying powder was produced through granulation. The spraying powder was observed with a SEM. The results are shown in FIG. 3B. Using the spraying powder, a sprayed coating was deposited on the surface of the substrate under the same conditions as those in Example 1 so as to produce a sprayed test piece.

Comparative Example 3

Commercial spraying powder was prepared. Specifically, a NiCr-based alloy of NiCr-based alloy particles contains, as shown in Table 1, 75 mass % of Ni, 16 mass % of Cr, and 9 mass % of Fe and does not contain silicon or the like. The melting point of the powder was measured with a differential thermogravimetric analysis apparatus as in Example 1. The results are shown in Table 1.

In addition, the powder was mixed with h-BN particles and Al particles such that the resulting spraying powder contained 6.5 mass % of h-BN particles, 3.5 mass % of Al particles, and a balance of NiCr-based alloy particles. Then, the h-BN particles and Al particles were bonded to the peripheries of the NiCr-based alloy particles via binder resin so that spraying powder was produced through granulation. The spraying powder was observed with a SEM. The results are shown in FIG. 3B. Using the spraying powder, a sprayed coating was deposited on the surface of a substrate under the same conditions as those in Example 1 so as to produce a sprayed test piece.

[Machinability Test 1]

Figure 5:
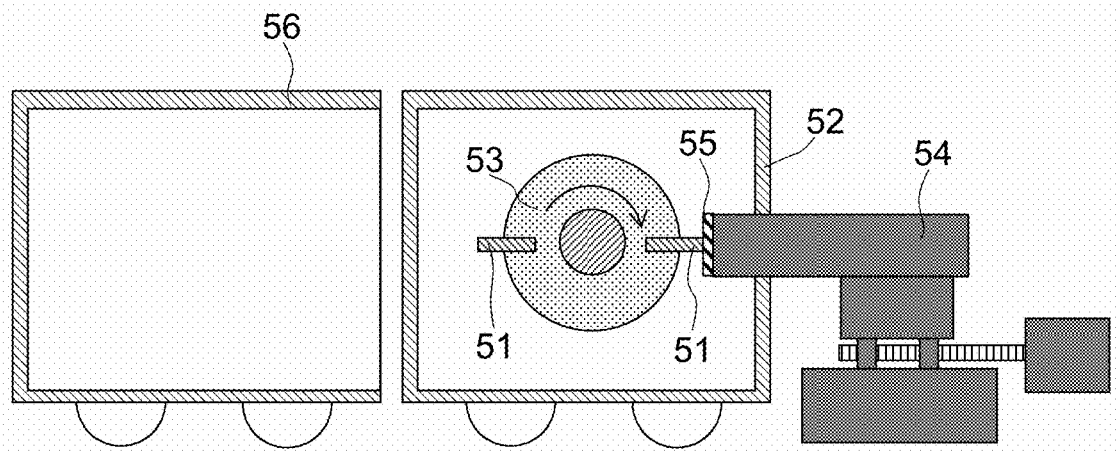
FIG. 5 is a schematic diagram of a machinability testing device.

A machinability test was conducted on each of the sprayed test pieces of Examples 1 and 2 and Comparative Examples 1 to 3 using a machinability testing device shown in FIG. 5. Specifically, two chip-form test pieces 51 made of the same material as that (nickel alloy (Inconel 713)) of the turbine wheel of the turbocharger of the automobile were prepared as counterpart members and were attached to a rotor 53. Next, the position of the sprayed test piece 55 attached to a movable device 54 was fixed in a state of abutting the chip-form test pieces 51. The rotor 53 was rotated at a rotational speed of 1200 rpm, and the chip-form test pieces 51 were pressed against the sprayed test piece 55 at a feed rate of 25 μm/second. The rotation of the rotor 53 was stopped when the pressing load reached 30 N.

Figure 6:
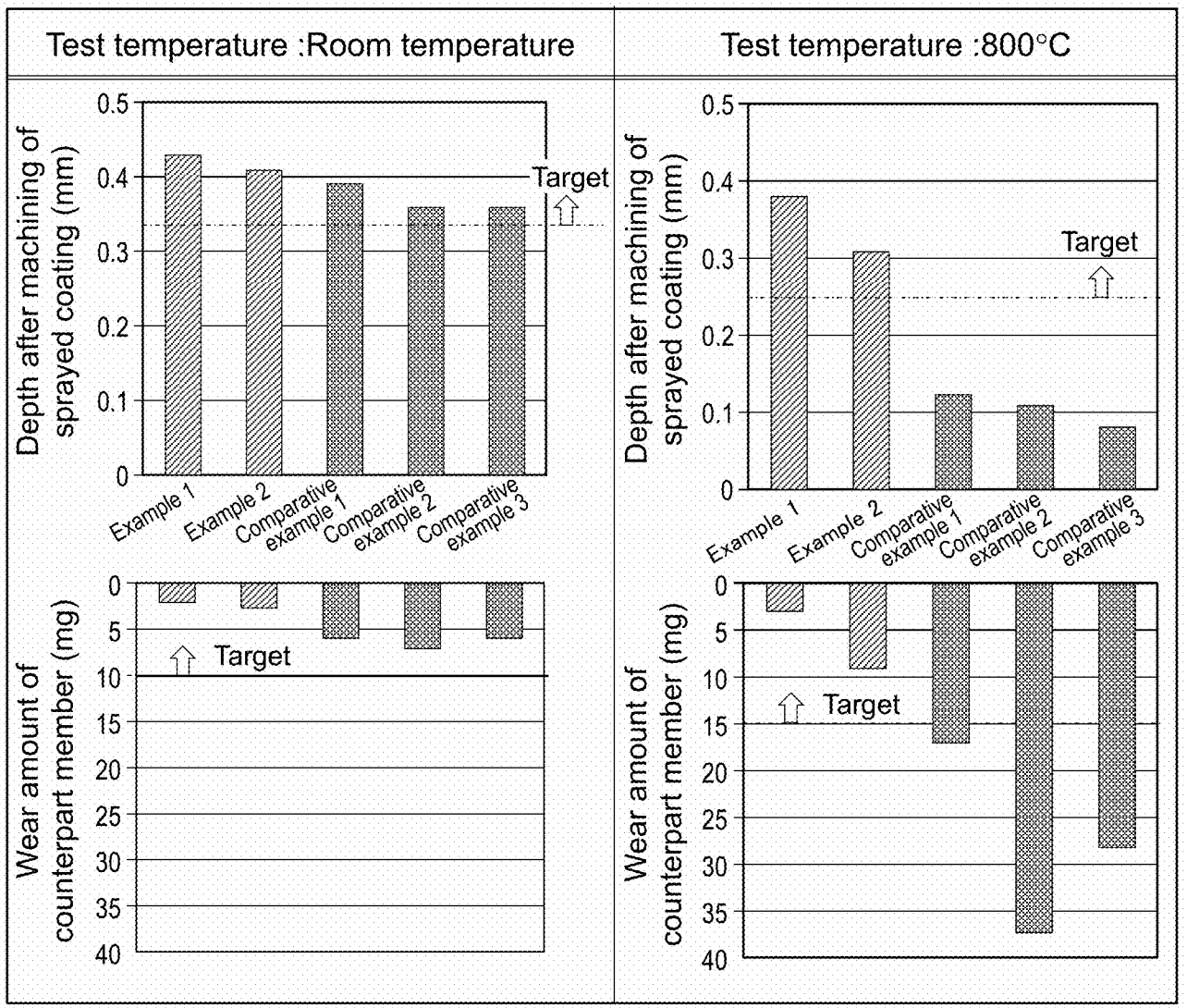
FIG. 6 shows graphs of the relationships of, when Machinability Test 1 was conducted on the sprayed test pieces of Examples 1 and 2 and Comparative Examples 1 to 3 under the conditions of the test temperature set to the room temperature and 800° C., the depths after the machining of the sprayed coatings and the wear amounts of counterpart members.

It should be noted that Machinability Test 1 was conducted on the sprayed test pieces under the conditions of the test temperature set to the room temperature and 800° C. (by heating the inside of a heating furnace 52 with a mobile heater 56). The results are shown in FIG. 6. FIG. 6 shows graphs of the relationships of, when Machinability Test 1 was conducted on the sprayed test pieces of Examples 1 and 2 and Comparative Examples 1 to 3 under the conditions of the test temperature set to the room temperature and 800° C., the depths after the machining of the sprayed coatings and the wear amounts of the counterpart members. It should be noted that the wear amounts of the counterpart members refer to the wear amounts of the chip-form test pieces 51.

Figure 7:
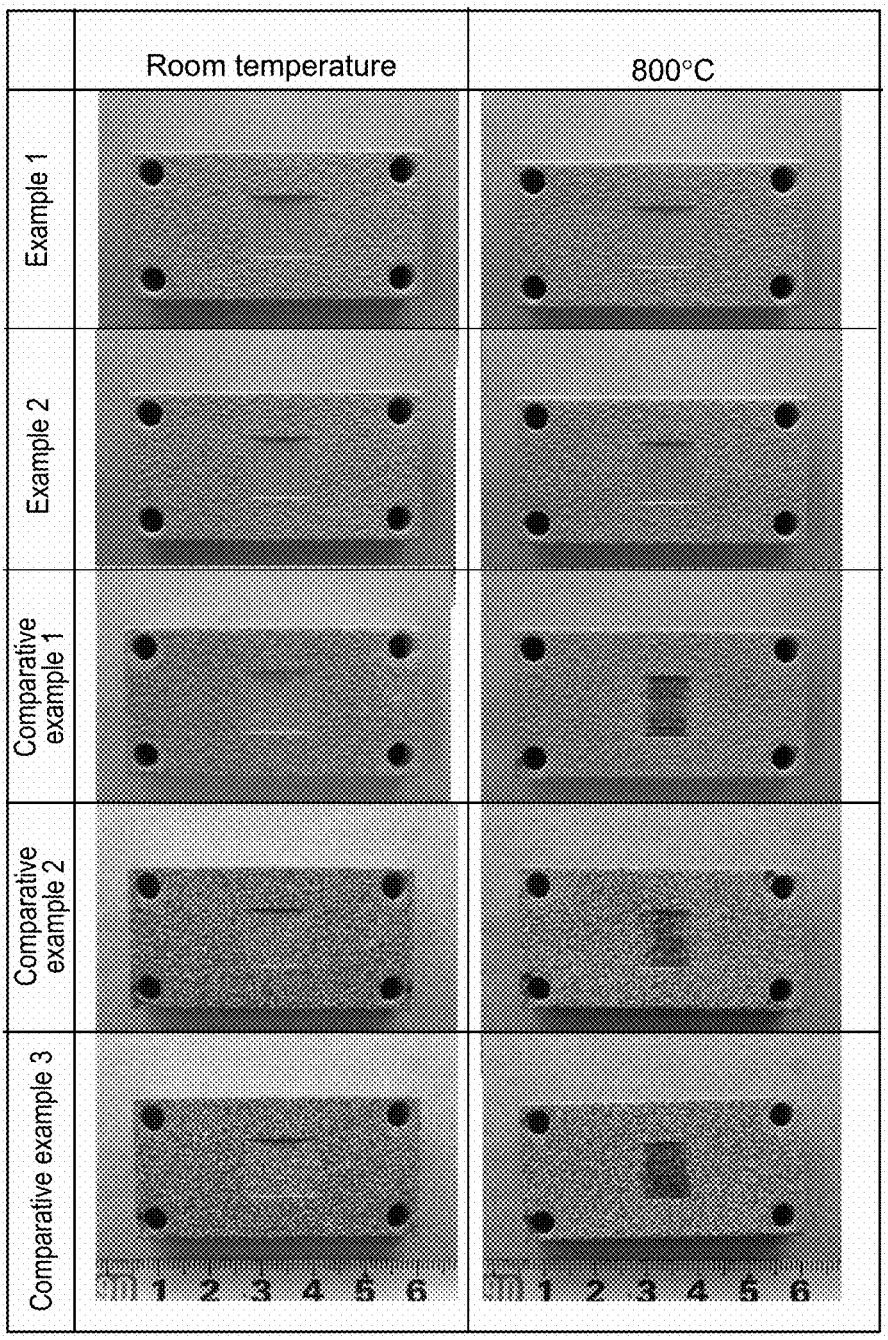
FIG. 7 shows photographs of sprayed coatings obtained after Machinability Test 1 was conducted on the sprayed test pieces of Examples 1 and 2 and Comparative Examples 1 to 3 under the conditions of the test temperature set to the room temperature and 800° C.

Further, the sprayed coatings remaining after Machinability Test 1 was conducted on the sprayed test pieces of Examples 1 and 2 and Comparative Examples 1 to 3 under the conditions of the test temperature set to the room temperature and 800° C. were observed. FIG. 7 shows photographs of such sprayed coatings.

[Result 1]

As shown in FIG. 6, at the test temperature of the room temperature, the depths after the machining of the sprayed coatings of Examples 1 and 2 and Comparative Examples 1 to 3 are all found to be greater than the target value, and the depths after the machining of the sprayed coatings of Examples 1 and 2 are found to be greater than those of Comparative Examples 1 to 3. Further, the wear amounts of the counterpart members of Examples 1 and 2 and Comparative Examples 1 to 3 are all found to be smaller than the target value, and the wear amounts of the counterpart members of Examples 1 and 2 are found to be smaller than those of Comparative Examples 1 to 3.

However, at the test temperature of 800° C., although the depth after the machining of each of the sprayed coatings of Examples 1 and 2 is found to be greater than the target value, the depth after the machining of each of the sprayed coatings of Comparative Examples 1 to 3 is found to be significantly lower than that at the room temperature and also lower than the target value. In addition, although the wear amount of each of the counterpart members of Examples 1 and 2 is found to be smaller than the target value, the wear amount of each of the counterpart members of Comparative Examples 1 to 3 is found to be significantly greater than that at the room temperature and also greater than the target value.

Further, as shown in FIG. 7, at the test temperature of the room temperature, normal abrasive wear was confirmed on each of the sprayed coatings of Examples 1 and 2 and Comparative Examples 1 to 3. However, at the test temperature of 800° C., although normal abrasive wear was confirmed on each of the sprayed coatings of Examples 1 and 2, adhesive wear was confirmed on each of the sprayed coatings of Comparative Examples 1 to 3. From the results, it is considered that at the test temperature of 800° C., each of the sprayed coatings of Comparative Examples 1 to 3 had lower machinability than those of Examples 1 and 2 due to the adhesion of the counterpart member thereto, and the wear amount of the counterpart member has also increased. To investigate the cause for this, the following were confirmed.

[Microscope Observation]

Figure 8:
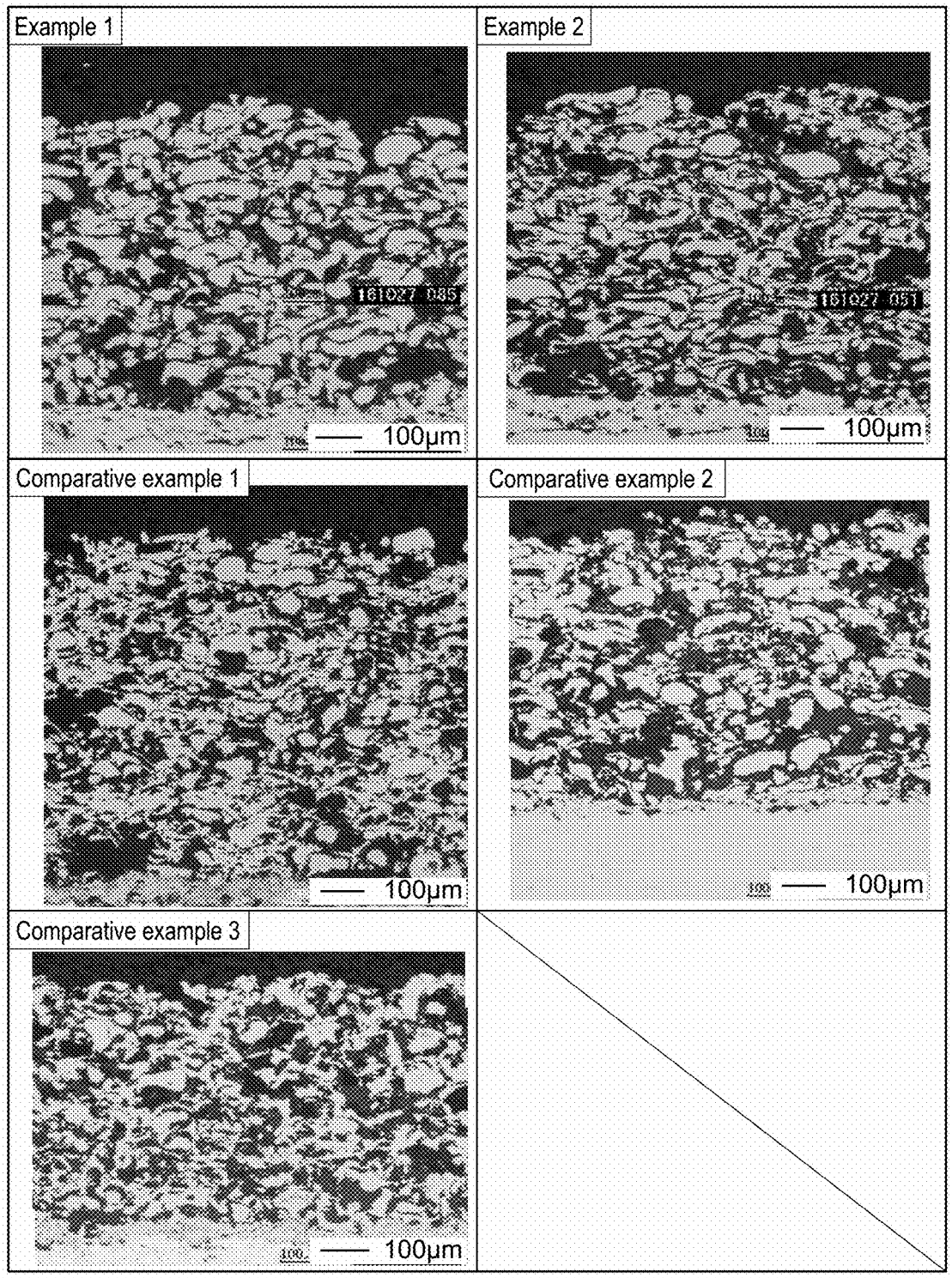
FIG. 8 shows cross-sectional photographs of the sprayed coatings of Examples 1 and 2 and Comparative Examples 1 to 3.

The cross-sections of the sprayed coatings of Examples 1 and 2 and Comparative Examples 1 to 3 were observed with a SEM. The results are shown in FIG. 8. FIG. 8 shows cross-sectional photographs of the sprayed coatings of Examples 1 and 2 and Comparative Examples 1 to 3. As shown in FIG. 8, the sprayed coatings of Examples 1 and 2 and Comparative Examples 1 to 3 each have porous structures including pores, and no big difference is found among them.

[X-Ray Photoelectron Spectrometry (XPS)]

Figure 9:
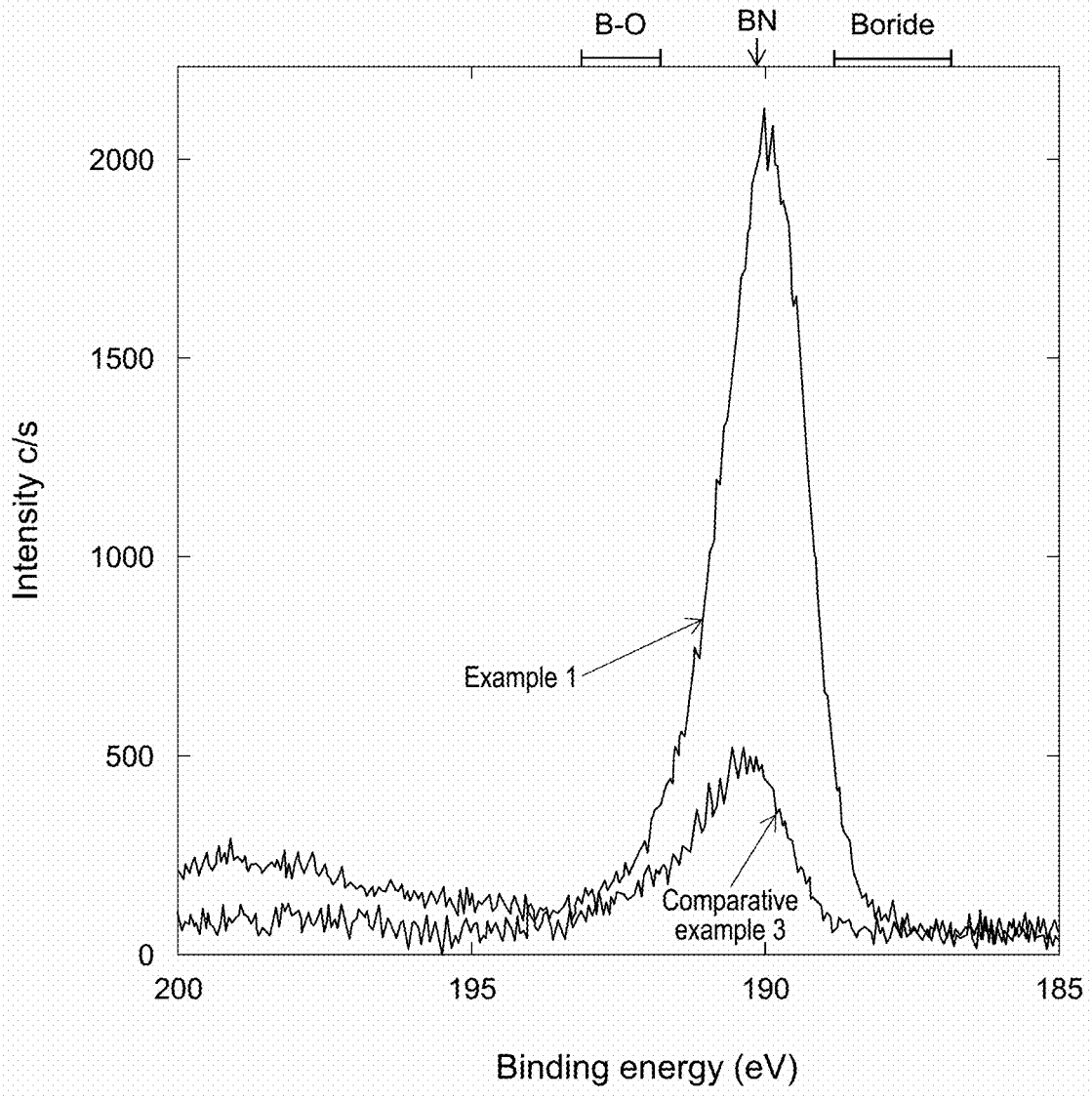
FIG. 9 shows graphs of the results of performing X-ray photoelectron spectrometry of the sprayed coatings of Example 1 and Comparative Example 3.

X-ray photoelectron spectrometry (XPS) was conducted on the surface, specifically, in the range of 1400 μm×500 μm, of each of the sprayed coatings of Example 1 and Comparative Example 3 using an X-ray photoelectron spectrometry system (Quantrea SXM produced by ULVAC-PHI, INCORPORATED). The results are shown in FIG. 9. FIG. 9 shows graphs of the results of performing X-ray photoelectron spectrometry of the sprayed coatings of Example 1 and Comparative Example 3. It should be noted that Table 2 shows the proportions of the primary elements in the sprayed coatings calculated from the results in FIG. 9. As shown in FIG. 9 and Table 2, it is found that the outermost surface of the sprayed coating of Example 1 contains more B and N than that of Comparative Example 3.

TABLE 2

| | Example 1 (atomic %) | Comparative Example 3 (atomic %) |
|---|---|---|
| B | 46.3 | 14.3 |
| N | 45.5 | 16.1 |
| Al | 7 | 66.7 |
| Si | 1 | 1.2 |
| Ni | 0.2 | 1.7 |

[Auger Spectrometry (AES)]

Figure 10:
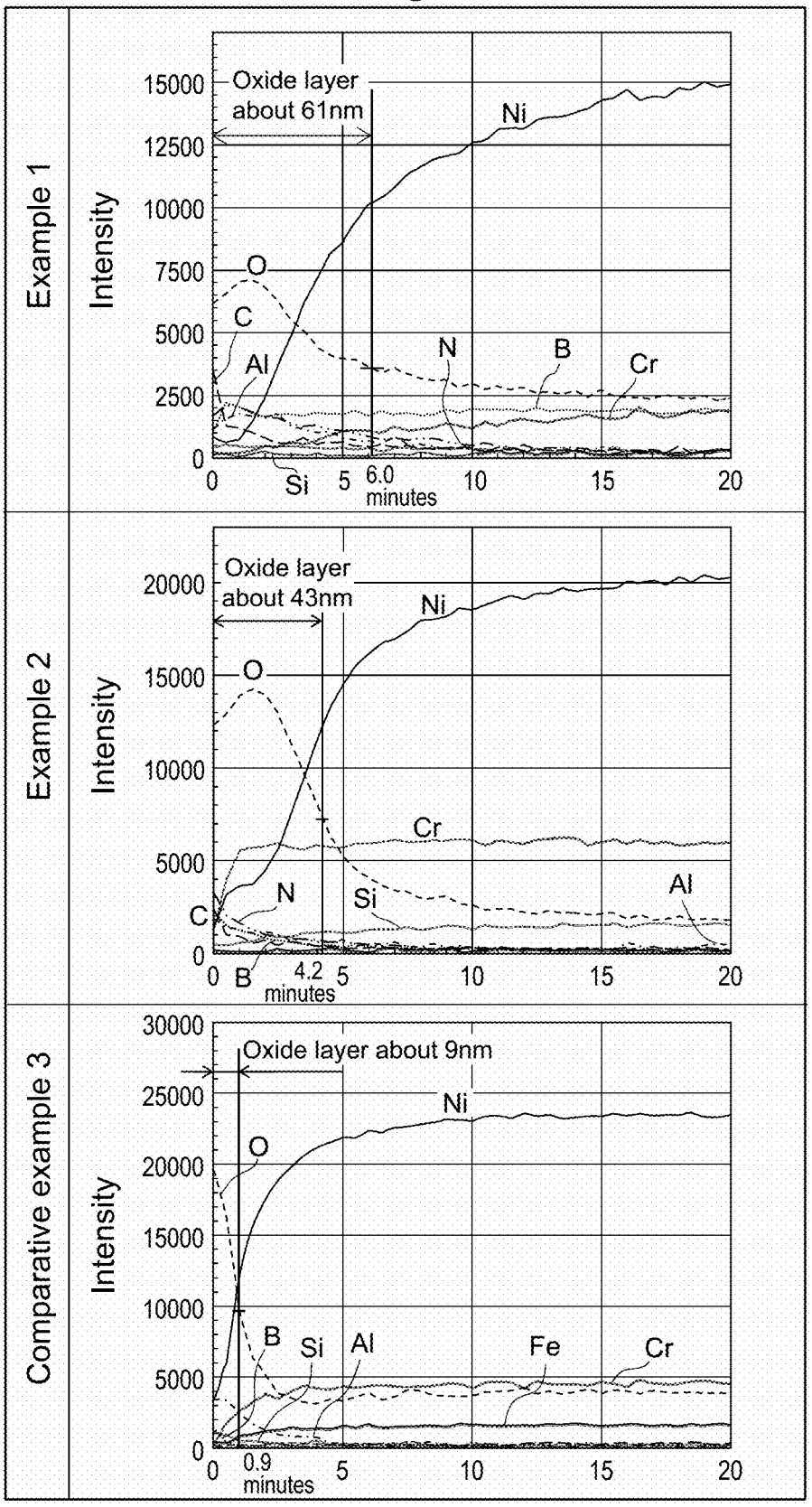
FIG. 10 shows graphs of the results of performing Auger spectrometry of the sprayed coatings of Examples 1 and 2 and Comparative Example 3.

Auger spectrometry (AES) was conducted on the sprayed coatings of Examples 1 and 2 and Comparative Example 3. The results are shown in FIG. 10. FIG. 10 shows graphs of the results of performing Auger spectrometry (AES) of the sprayed coatings of Examples 1 and 2 and Comparative Example 3. As shown in FIG. 10, the sprayed particles forming the sprayed coatings of Examples 1 and 2 each have formed thereon oxide layers that are thicker than those of Comparative Example 3.

[EPMA Line Analysis]

Figure 11:
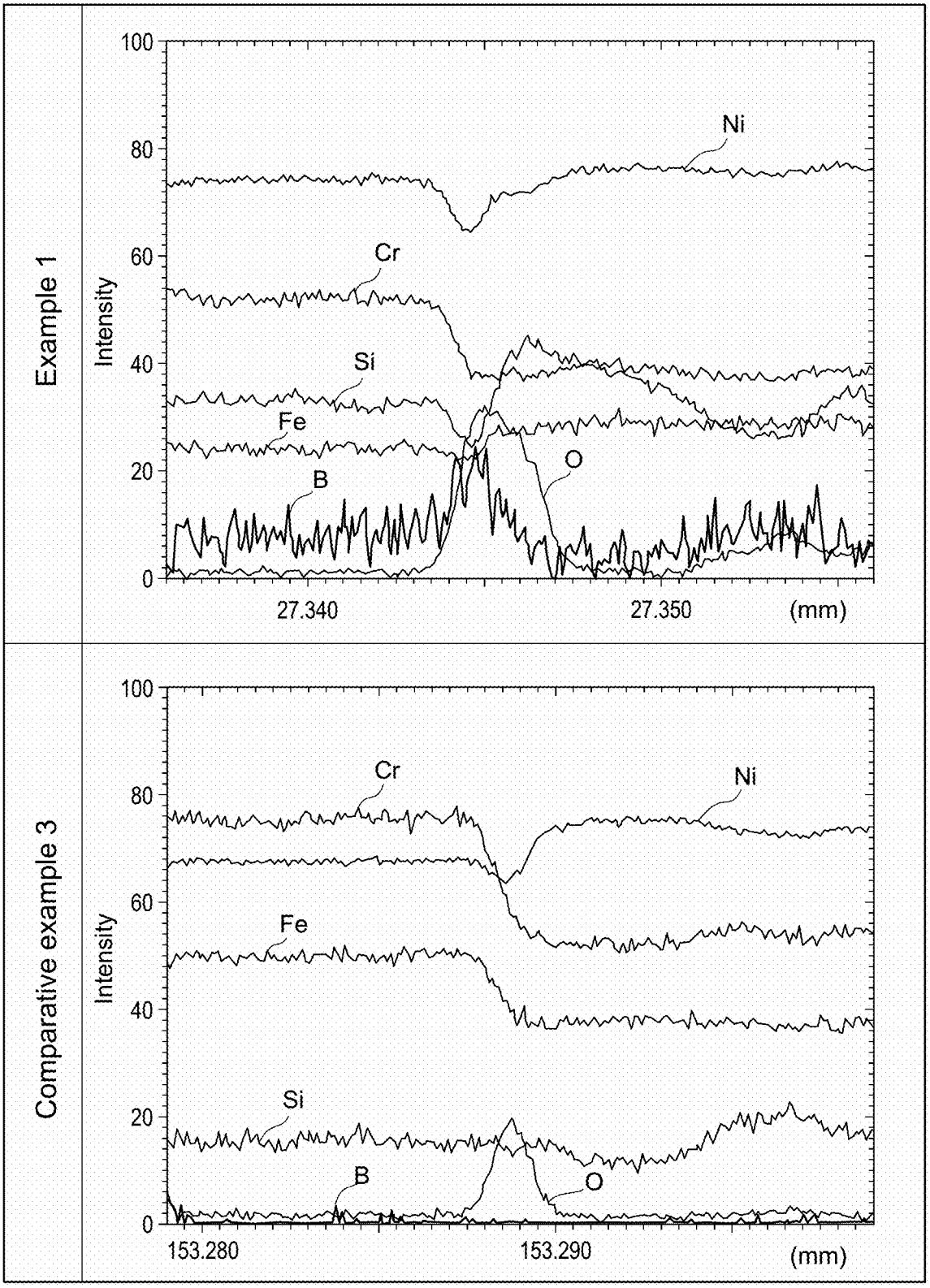
FIG. 11 shows graphs of the results of performing EPMA line analysis on portions between NiCr-based alloy particles of the sprayed coatings of Example 1 and Comparative Example 3.

EPMA line analysis was conducted on the portions between the NiCr-based alloy particles of the sprayed coatings of Example 1 and Comparative Example 3. The results are shown in FIG. 11. FIG. 11 shows graphs of the results of performing EPMA line analysis on the portions between the NiCr-based alloy particles of the sprayed coatings of Example 1 and Comparative Example 3. From the results, in the portions between the NiCr-based alloy particles of the sprayed coating of Example 1, B (boron) was observed to have a larger peak than that in Comparative Example 3.

[Very-High-Resolution EPMA Line Analysis]

Figure 12A:
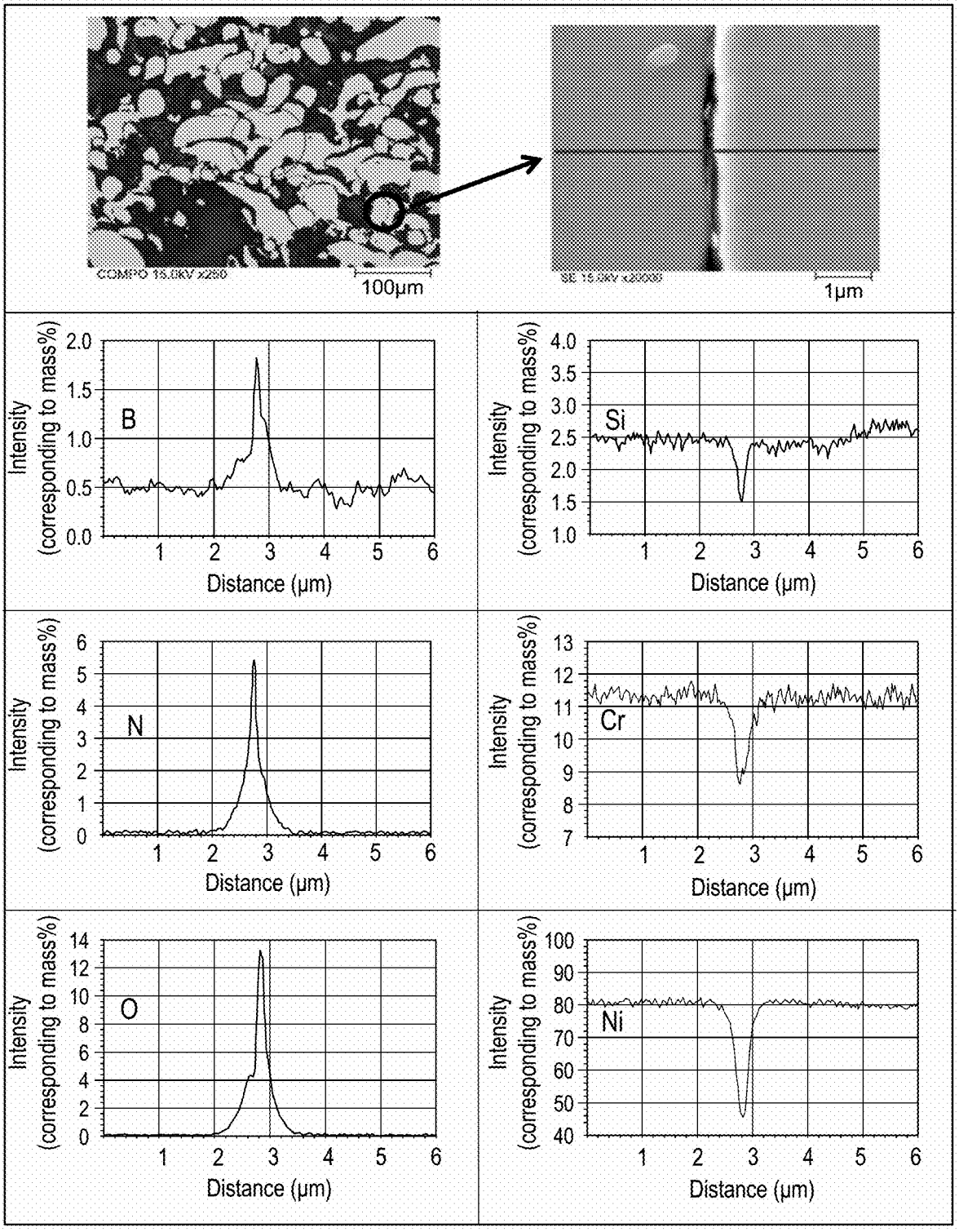
FIG. 12A shows graphs of the results of performing very-high-resolution EPMA line analysis of B, Si, N, Cr, O, and Ni on portions between NiCr-based alloy particles in the cross-section of the sprayed coating of Example 1 shown in the photograph.
Figure 12B:
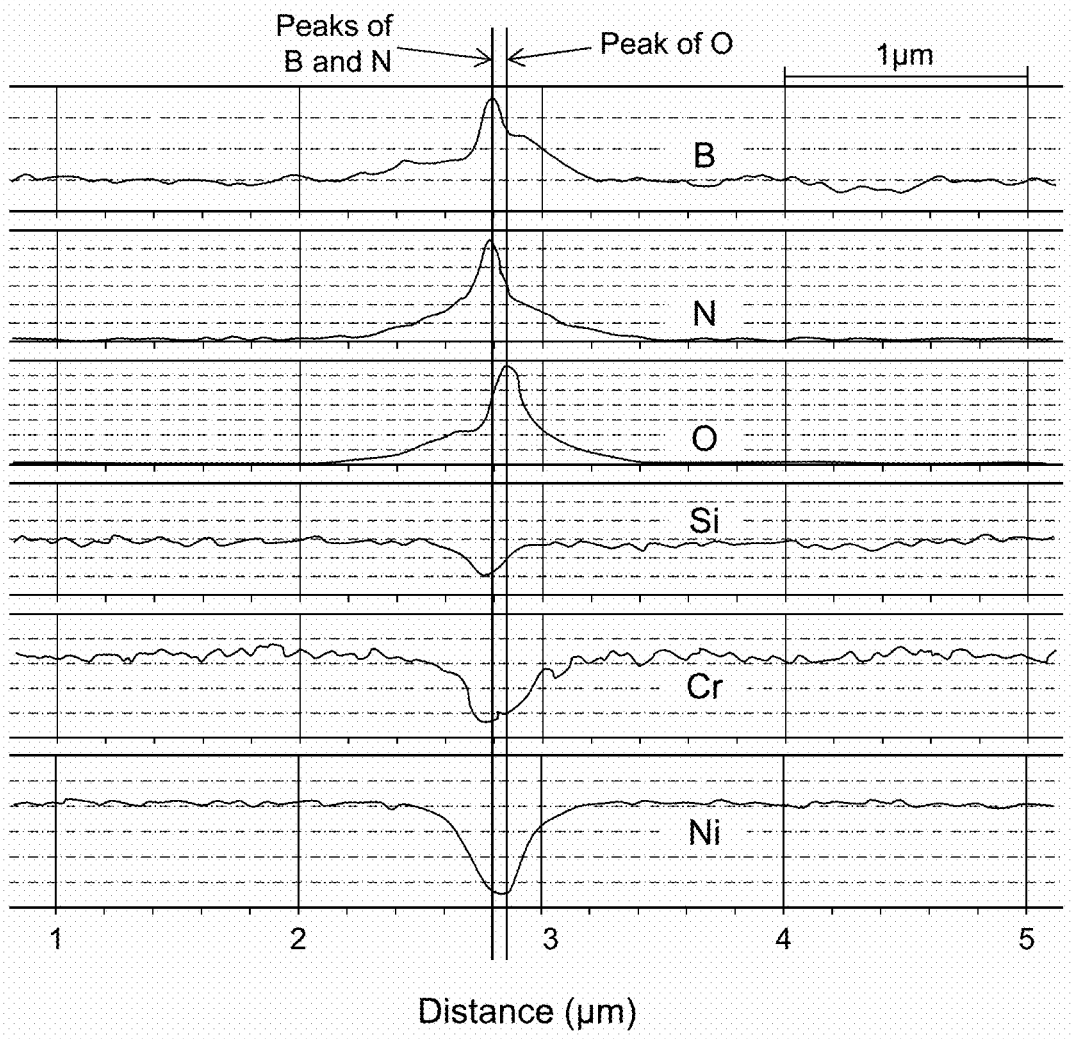
FIG. 12B is an enlarged view of the graphs in FIG. 12A.

Herein, very-high-resolution EPMA line analysis was conducted on the portion between given NiCr-based alloy particles in the cross-section of the sprayed coating of Example 1. The results are shown in FIGS. 12A and 12B. FIG. 12A shows graphs of the results of performing very-high-resolution EPMA line analysis of B, Si, N, Cr, O, and Ni on the portion between the NiCr-based alloy particles in the cross-section of the sprayed coating of Example 1 shown in the photograph. FIG. 12B is an enlarged view of FIG. 12A.

As shown in FIG. 12A, peaks of B (boron) and N (nitrogen) were detected between the NiCr-based alloy particles. That is, it is considered that h-BN particles are present between the NiCr-based alloy particles and such h-BN particles cover the entire surfaces of the NiCr-based alloy particles with high possibility. Further, as shown in FIG. 12B, there is a slight difference between the peaks of B and N and the peak of O (oxygen), and from such result, it is considered that h-BN particles are bonded to the surfaces of the oxide layers of the NiCr-based alloy particles.

Herein, the oxide layers of the NiCr-based alloy particles are considered to be layers containing oxide of Si (silicon) and B (boron). The melting point of oxide of Si ($SiO_2$: 1600° C.) and the melting point of oxide of B ($B_2O_4$: 480° C.) are lower than the melting point of oxide of Cr ($Cr_2O_3$: 2435° C.) and the melting point of oxide of Ni (NiO: 1984° C.), and also, the standard free energy of formation of oxide with Si and B is lower. Therefore, oxide of Si and oxide of B are more likely to be formed than are oxide of Cr and oxide of Ni.

Accordingly, the sprayed coatings of Examples 1 and 2 were found to have higher machinability at high temperatures than those of Comparative Examples 1 to 3, and the outermost surfaces were found to contain more B and N. In addition, the NiCr-based alloy particles of the sprayed coatings of Examples 1 and 2 were found to have oxide layers of Si and B formed thereon that are thicker than those of Comparative Examples 1 to 3. Almost no B or N was found in the portions between the NiCr-based alloy particles of the sprayed coatings of Comparative Examples 1 to 3, whereas B and N were generally found to be present in the portions between the NiCr-based alloy particles of the sprayed coatings of Examples 1 and 2.

When the spraying powder of Example 1 or Example 2 is sprayed, a NiCr-based alloy with higher thermal conductivity than that of h-BN melts. Then, oxide layers of $SiO_2$ and $B_2O_4$ in the liquid-phase state are formed on the surfaces of the NiCr-based alloy particles. Since the oxide layers in the liquid-phase state have high wettability, it is considered that such oxide layers hold the h-BN particles. Consequently, even during spraying, the h-BN particles covering the NiCr-based alloy particles become difficult to scatter, and even when the h-BN particles scatter and collide with the substrate with the result that the NiCr-based alloy particles deform, it is considered that the h-BN particles are held while being stuck to the NiCr-based alloy particles. Therefore, it is considered that in comparison with the sprayed coatings of Comparative Examples 1 to 3, each of the sprayed coatings of Examples 1 and 2 has more h-BN particles left on the surface of the sprayed coating as well as in the portions between the NiCr-based alloy particles of the sprayed coating. Accordingly, it is considered that each of the sprayed coatings of Examples 1 and 2 is less likely to wear adhesively even at high temperatures in comparison with the sprayed coatings of Comparative Examples 1 to 3 and thus has enhanced machinability. Herein, it is commonly considered that B and N will lose their solid lubricity when they are exposed to high temperatures for a long time and thus are oxidized. Herein, Machinability Test 2 below was further conducted.

[Machinability Test 2]

Figure 13:
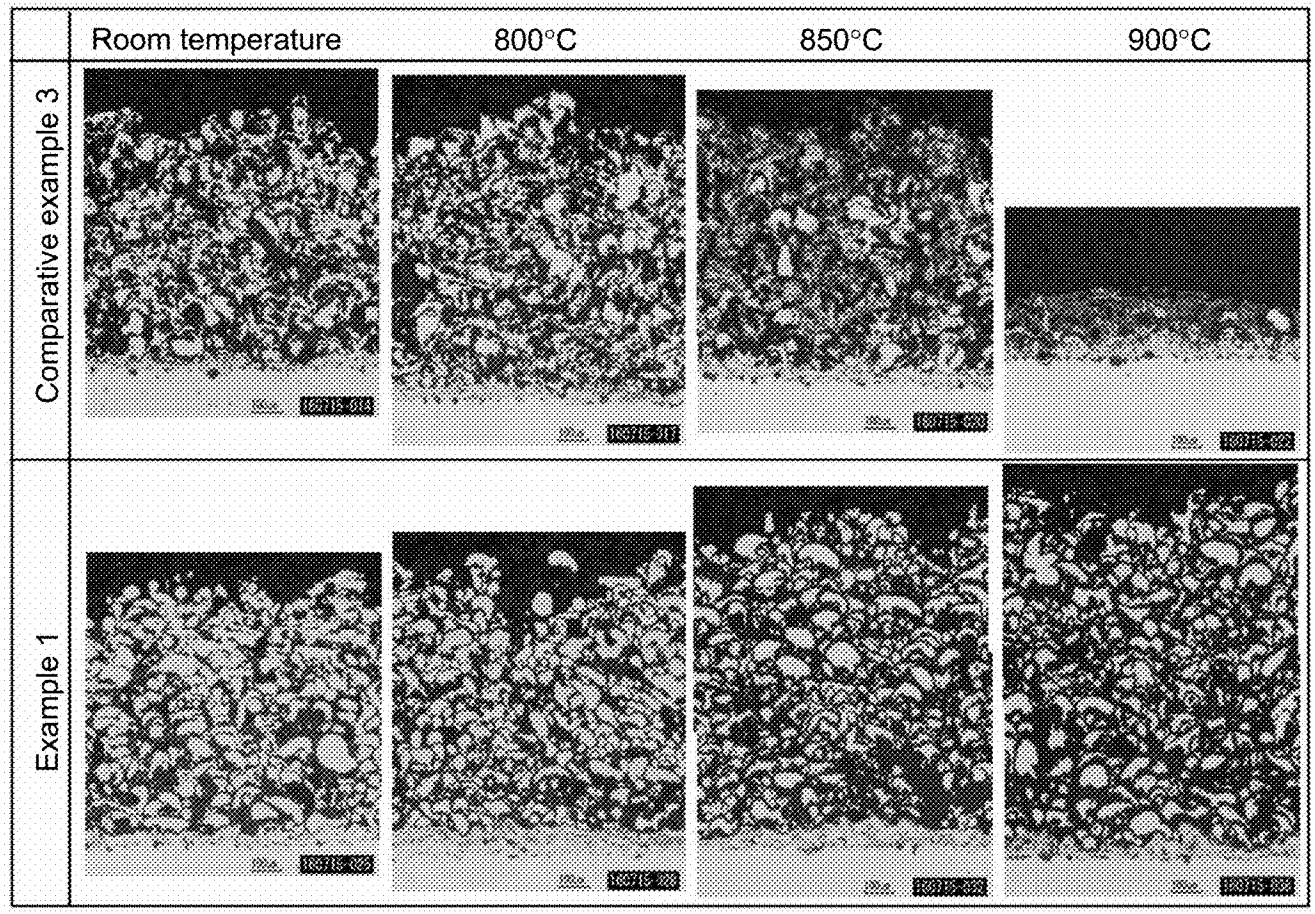
FIG. 13 shows photographs of tissue in the cross-sections of the sprayed coatings of Example 1 and Comparative Example 3 at the room temperature, 800° C., 850° C., and 900° C.
Figure 14:
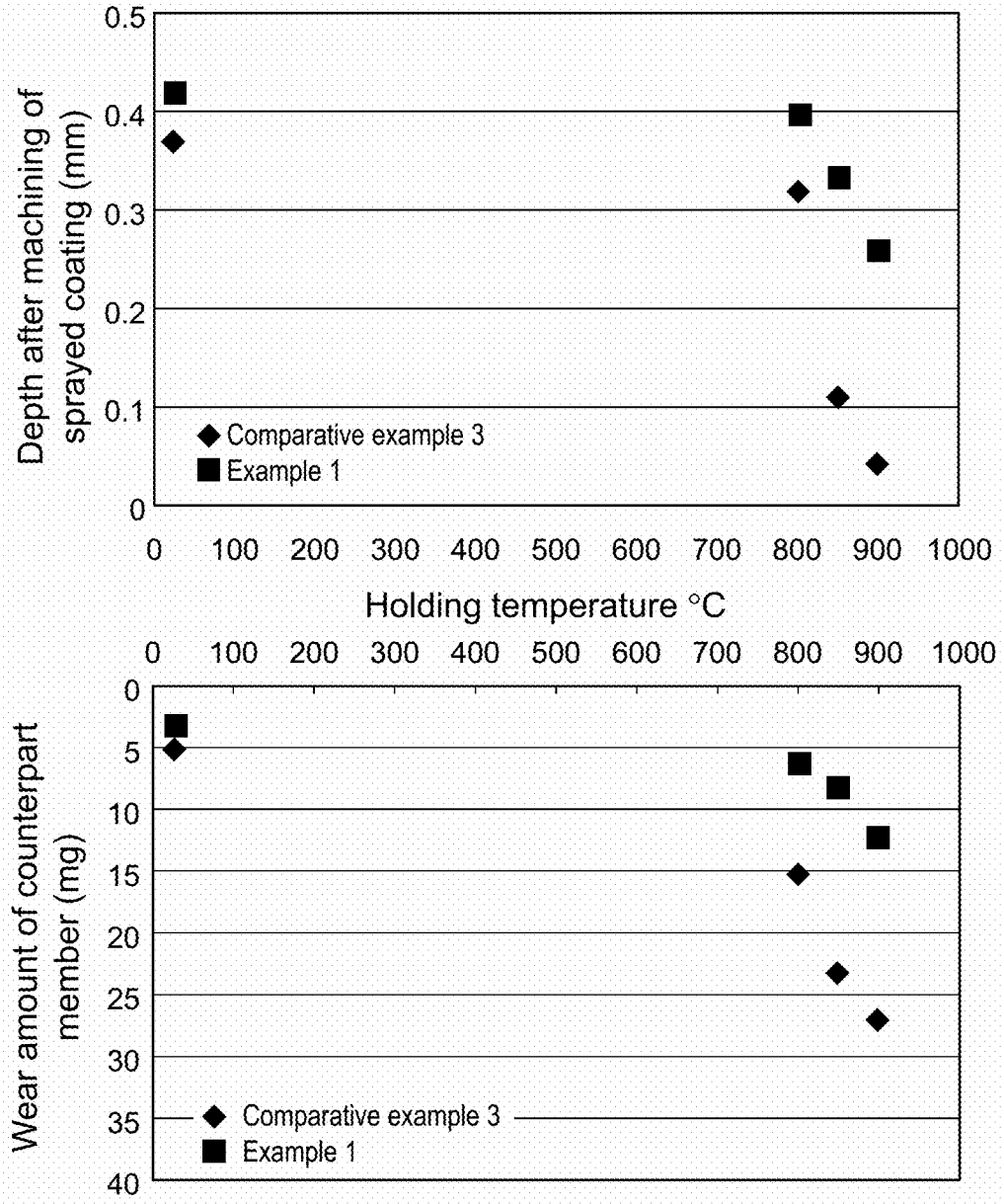
FIG. 14 shows graphs of the relationships of, regarding the sprayed test pieces of Example 1 and Comparative Example 3, the depths after the machining of the sprayed coatings and the wear amounts of counterpart members at holding temperatures of the room temperature, 800° C., 850° C., and 900° C.

A plurality of sprayed test pieces of Example 1 and Comparative Example 3 were further prepared, and the respective sprayed test pieces were heated at holding temperatures of 800° C., 850° C., and 900° C. in the atmosphere (oxygen atmosphere) for 300 hours. FIG. 13 shows photographs of tissue in the cross-sections of the sprayed coatings of Example 1 and Comparative Example 3 at the room temperature, 800° C., 850° C., and 900° C. Next, the same test as Machinability Test 1 described above was conducted on each of the sprayed test pieces of Example 1 and Comparative Example 3. The results are shown in FIG. 14. FIG. 14 shows graphs of the relationships of, regarding the sprayed test pieces of Example 1 and Comparative Example 3, the depths after the machining of the sprayed coatings and the wear amounts of counterpart members at holding temperatures of the room temperature, 800° C., 850° C., and 900° C.

As shown in FIG. 13, at a holding temperature of 900° C., the sprayed coating of Comparative Example 3 partially came off due to oxidation. Meanwhile, although the sprayed coating of Example 1 had thick oxide layers formed in the grain boundaries of the NiCr-based alloy particles, the sprayed coating was held on the substrate. This is considered to be due to the reason that since the sprayed coating of Example 1 contained Si, the oxidation resistance of the sprayed coating was able to be enhanced even at a temperature of greater than or equal to 850° C.

Further, the sprayed coating of Example 1 was held even after Machinability Test 2 of 900° C. was conducted. Further, as shown in FIG. 14, it is also found that when the sprayed coating of Comparative Example 3 was held at a high temperature of greater than or equal to 800° C., the depth after the machining was smaller and thus the machinability was lower in comparison with that of Example 1, and the wear amount of the counterpart member was also large.

Figure 15:
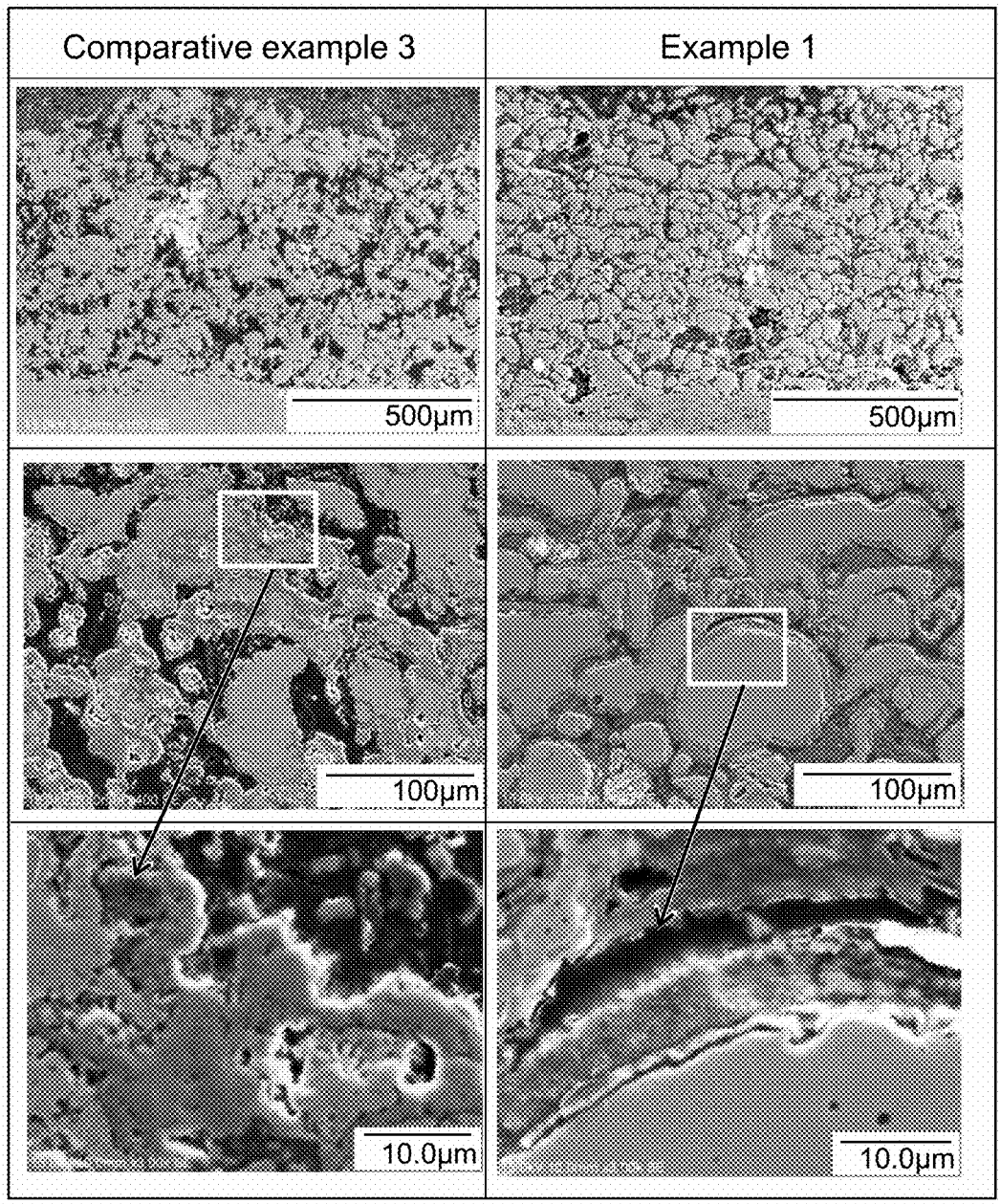
FIG. 15 shows cross-sectional photographs of the sprayed coatings when the test pieces of Example 1 and Comparative Example 3 were heated under a heating condition of 850° C. for 300 hours.
Figure 16:
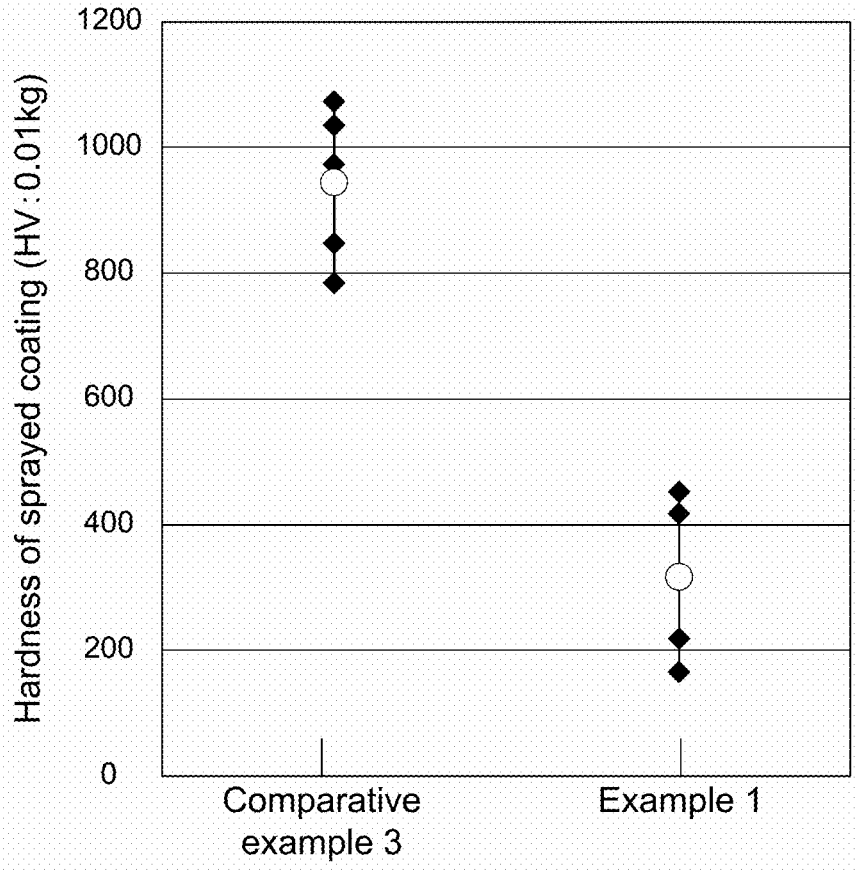
FIG. 16 shows a graph of the Vickers hardness of oxide of the sprayed coating when each of the test pieces of Example 1 and Comparative Example 3 was heated under a heating condition of 850° C. for 300 hours.

To confirm the reasons therefor, the cross-sections of the sprayed coatings when the sprayed test pieces of Example 1 and Comparative Example 3 were held at 850° C. for 300 hours were observed with a SEM. Then, the Vickers hardness was measured at five points of the oxide of each sprayed coating. The results are shown in FIGS. 15 and 16. FIG. 15 shows cross-sectional photographs of the sprayed coatings when the sprayed test pieces of Example 1 and Comparative Example 3 were heated under a heating condition of 850° C. for 300 hours. FIG. 16 shows a graph of the Vickers hardness of the oxide of the sprayed coating when each of the test pieces of Example 1 and Comparative Example 3 was heated under a heating condition of 850° C. for 300 hours. It should be noted that ♦ in FIG. 16 indicates the Vickers hardness at each measurement point, and ○ indicates the average value thereof.

As shown in FIG. 15, regarding the sprayed coating of Example 1, it is found that oxide layers covering the NiCr-based alloy particles formed by being held at a high temperature clearly divide the metal portions to be the base materials of the NiCr-based alloy particles. In contrast, regarding the sprayed coating of Comparative Example 3, it is found that the entire NiCr-based alloy particles are oxidized by being held at a high temperature and the adjacent NiCr-based alloy particles are tightly attached together via oxide.

As shown in FIG. 16, the Vickers hardness of the oxide of the sprayed coating of Example 1 is lower than that of Comparative Example 3, and thus the oxide of the sprayed coating of Example 1 is found to be softer than that of Comparative Example 3. In the case of Comparative Example 3, it is considered that the sintering of the NiCr-based alloy particles has progressed along with the generation of the oxide, and consequently, the machinability of the sprayed coating of Comparative Example 3 has become lower than that of Example 1. Meanwhile, in the case of Example 1, the sintering of the NiCr-based alloy particles was difficult to progress in comparison with that in Comparative Example 3 due to the presence of h-BN particles contained in a greater amount than those in Comparative Example 3, and further, the oxide of the sprayed coating formed was softer. Therefore, it is considered that the sprayed coating of Example 1 has higher machinability than that of Comparative Example 3.

[Test for Confirming Sticking Amount]

Figure 17:
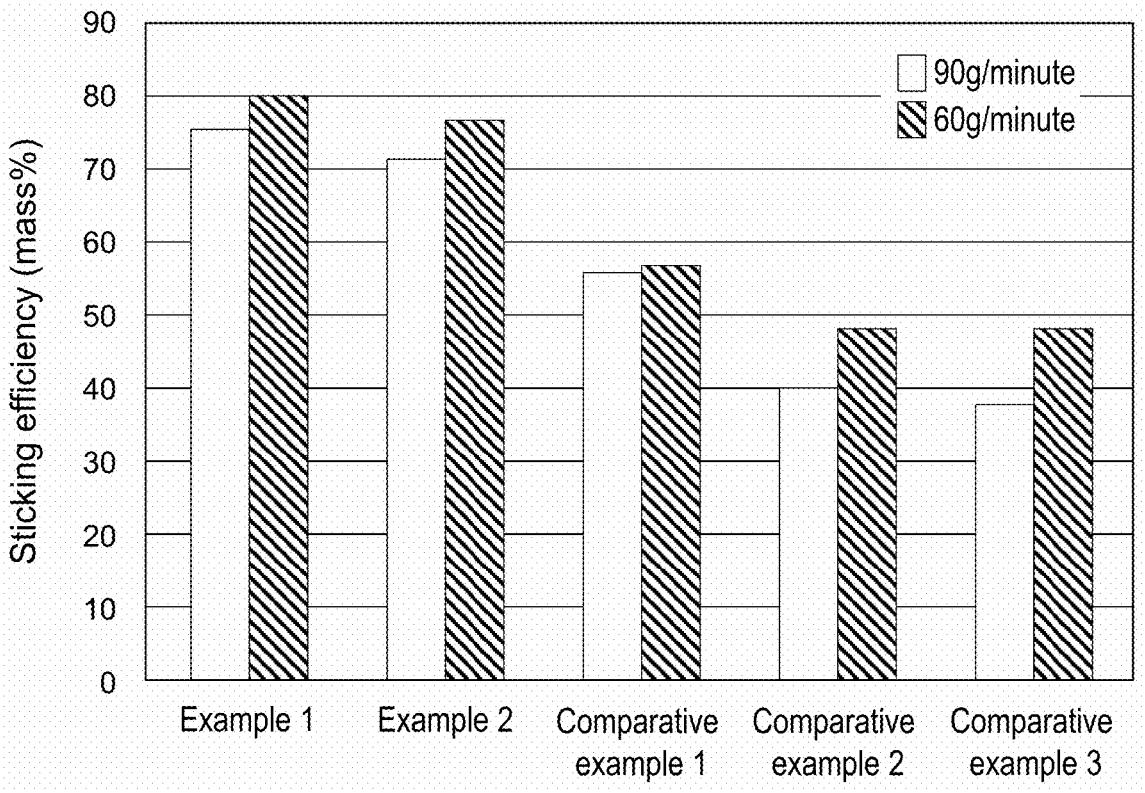
FIG. 17 shows graphs of the results of measuring the sticking efficiency of the spraying powder of Examples 1 and 2 and Comparative Examples 1 to 3.

The spraying powder of Examples 1 and 2 and Comparative Examples 1 to 3 were fed under the conditions of the feed rate set to 90 g/minute and 60 g/minute so as to form sprayed coatings on the surfaces of substrates. Then, the sticking efficiency was measured from the relationship between the feed amount (mass) and the sticking amount of the spraying powder (the mass of the sprayed coating). The results are shown in FIG. 17. FIG. 17 shows graphs of the results of measuring the sticking efficiency of the spraying powder of Examples 1 and 2 and Comparative Examples 1 to 3.

As shown in FIG. 17, the spraying powder of Examples 1 and 2 are each found to have higher sticking efficiency than those of Comparative Examples 1 to 3. This is considered to be due to the reason that as shown in Table 1, as the melting point of the NiCr-based alloy particles of the spraying powder of each of Examples 1 and 2 is lower than those of Comparative Examples 1 to 3, the spraying powder of each of Examples 1 and 2 is more likely to melt while being sprayed than those of Comparative Examples 1 to 3 and thus that the wettability of the spraying powder has been enhanced.

As described above, Si and B are more easily oxidized than are Ni and Cr, and such elements can lower the melting point of a NiCr-based alloy of NiCr-based alloy particles. Therefore, using NiCr-based alloy particles containing Si and B as in Examples 1 and 2 can increase the wettability of the surfaces of the NiCr-based alloy particles by means of oxide of Si and oxide of B. Accordingly, the sticking efficiency of the spraying powder is increased and more h-BN particles are allowed to be present between the NiCr-based alloy particles of the resulting sprayed coating.

In addition, even when the sprayed coating is used at a high temperature for a long time, soft oxide layers that prevent the progress of sintering are newly formed with the shape of the sprayed coating maintained. Therefore, the machinability of the sprayed coating can be enhanced than those of the conventional ones.

Examples 3-1 to 3-6: Optimum Amounts of h-BN Particles

Sprayed test pieces were produced as in Example 1. A sprayed test piece of Example 3-1 was produced under the same conditions as those for Example 1. Sprayed test pieces of Examples 3-2 to 3-6 differ from that of Example 1 in that the contents of h-BN particles relative to the entire spraying powder were set to 4.0 mass %, 4.5 mass %, 6.5 mass %, 7.0 mass %, and 8.0 mass %, respectively. It should be noted that regarding Example 3-2, three identical sprayed test pieces were produced.

Examples 4-1 and 4-2

Sprayed test pieces were produced as in Example 1. The sprayed test pieces of Examples 4-1 and 4-2 differ from that of Example 1 in that the contents of h-BN particles relative to the entire spraying powder were set to 4.5 mass % and 5.5 mass %, respectively, and the feed rate of the spraying powder was set to 60 g/minute. It should be noted that regarding Example 4-1, two identical sprayed test pieces were produced.

Comparative Examples 4-1 to 4-4

Sprayed test pieces were produced as in Example 1. The sprayed test pieces of Comparative Examples 4-1 to 4-4 differ from that of Example 1 in that the contents of h-BN particles relative to the entire spraying powder were set to 3.5 mass %, 8.5 mass %, 10.2 mass %, and 15.0 mass %, respectively. It should be noted that regarding Example 4-3, two identical sprayed test pieces were produced.

Comparative Examples 5-1 and 5-2

Sprayed test pieces were produced as in Example 1. The sprayed test pieces of Comparative Examples 5-1 and 5-2 differ from that of Example 1 in that the contents of h-BN particles relative to the entire spraying powder were set to 8.5 mass % and 10.2 mass %, respectively and the feed rate of spraying powder was set to 60 g/minute.

Figure 18:
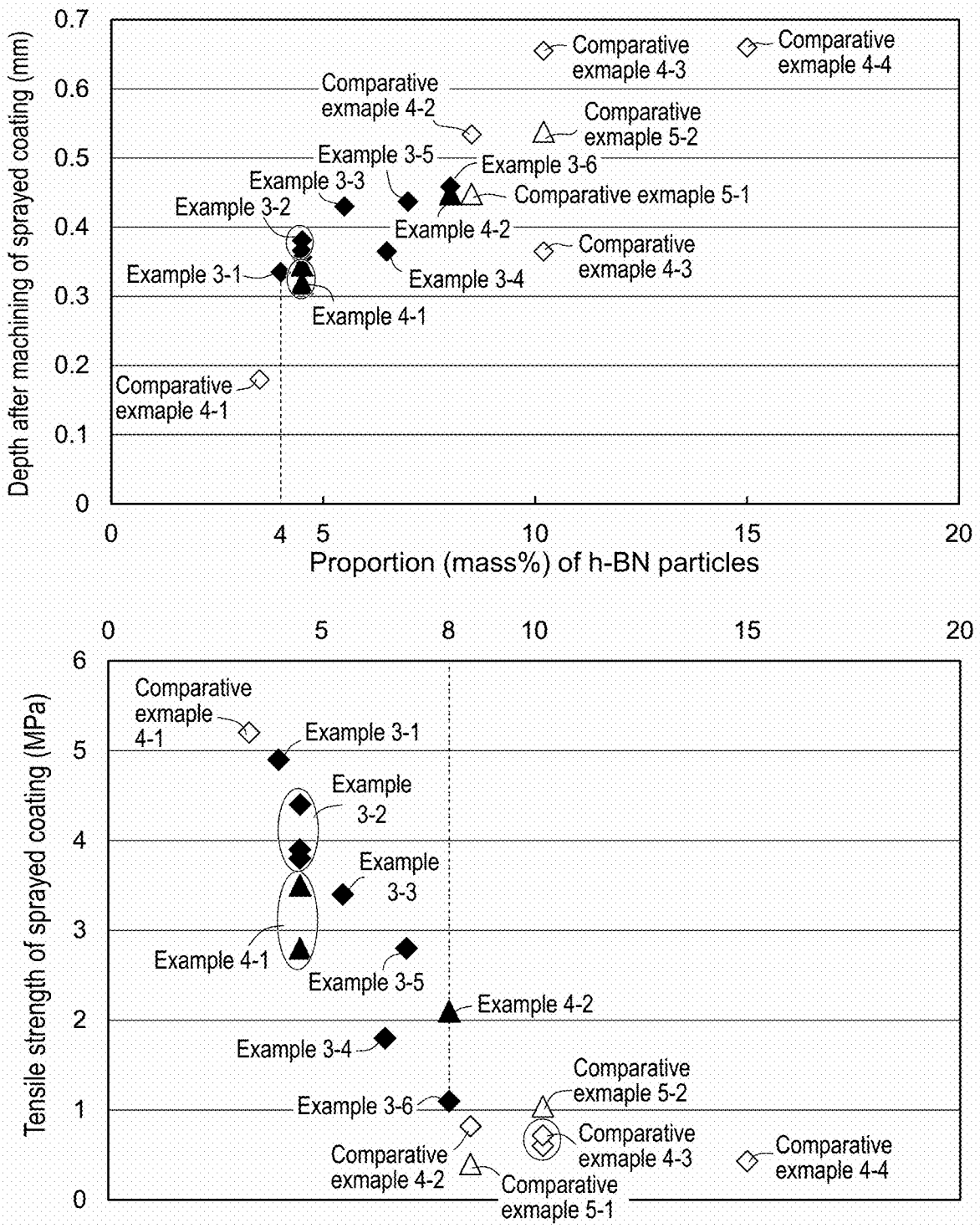
FIG. 18 show graphs of the results of measuring the depths after the machining and the tensile strengths of the sprayed coatings of Examples 3-1 to 3-6, Examples 4-1, 4-2, Comparative Examples 4-1 to 4-4, and Comparative Examples 5-1, 5-2.

The aforementioned Machinability Test 1 was conducted on each of the sprayed test pieces of Examples 3-1 to 3-6, Examples 4-1 and 4-2, Comparative Examples 4-1 to 4-4, and Comparative Examples 5-1 and 5-2 under the condition of 800° C. Further, the tensile strength of the sprayed coating of each sprayed test piece was measured. Specifically, a cylindrical jig was bonded to the sprayed coating of each sprayed test piece using an adhesive, and the sprayed coating was pulled in the perpendicular direction to the surface of the substrate with the jig fixed while a region of the sprayed coating around a portion on which the cylindrical jig was fixed was pressed so that the pressure when the sprayed coating was peeled off from the substrate was measured as the tensile strength. The results are shown in FIG. 18. FIG. 18 show graphs of the results of measuring the depths after the machining and the tensile strengths of the sprayed coatings of Examples 3-1 to 3-6, Examples 4-1, 4-2, Comparative Examples 4-1 to 4-4, and Comparative Examples 5-1, 5-2.

As shown in FIG. 18, the depth after the machining of each of the sprayed coatings of Examples 3-1 to 3-6 and Examples 4-1 and 4-2 is greater than that of Comparative Example 4-1. This is considered to be due to the reason that since each of the sprayed coatings of Examples 3-1 to 3-6 and Examples 4-1 and 4-2 contains greater than or equal to 4 mass % of h-BN particles, the machinability of the sprayed coating has been enhanced by means of the h-BN particles contained in the sprayed coating.

Meanwhile, as shown in FIG. 18, the tensile strength of each of the sprayed coatings of Examples 3-1 to 3-6 and Examples 4-1 and 4-2 is higher than those of Comparative Examples 4-2 to 4-4 and Comparative Examples 5-1 and 5-2. This is considered to be due to the reason that since each of the sprayed coatings of Comparative Examples 4-2 to 4-4 and Comparative Examples 5-1 and 5-2 contains greater than 8 mass % of h-BN particles, excess amounts of h-BN particles are present between the substrate and the sprayed coating as well as between the NiCr-based alloy particles of the sprayed coating.

Reference Examples 1 to 5: Preferred Spraying Method

Sprayed test pieces were produced as in Example 1. Reference Examples 1 to 5 differ from Example 1 in that the content of h-BN particles was set to 10.2 mass %.

Reference Example 2 further differs from Example 1 in that the feed rate of spraying powder was set to 60 g/minute.

Reference Example 3 further differs from Example 1 in that the feed rate of spraying powder was set to 80 g/minute, acetylene ($C_2H_2$) gas was used as fuel gas, the pressure of the acetylene gas was set to 15 psi, and the flow rate of the gas supplied was set as follows: oxygen gas: 43 NLPM and acetylene gas: 26 NLPM.

Reference Example 4 further differs from Example 1 in that a sprayed coating was deposited through plasma spraying, current was set to 450 A, the flow rate of argon gas was set to 150 L/minute, the feed rate of spraying powder was set to 60 g/minute, and the distance from the tip end of a thermal spraying gun to the substrate was set to 150 mm.

Reference Example 5 further differs from Example 1 in that a sprayed coating was deposited through plasma spraying, current was set to 450 A, the flow rate of argon gas was set to 100 L/minute, the feed rate of spraying powder was set to 60 g/minute, and the distance from the tip end of a thermal spraying gun to the substrate was set to 150 mm.

Figure 19:
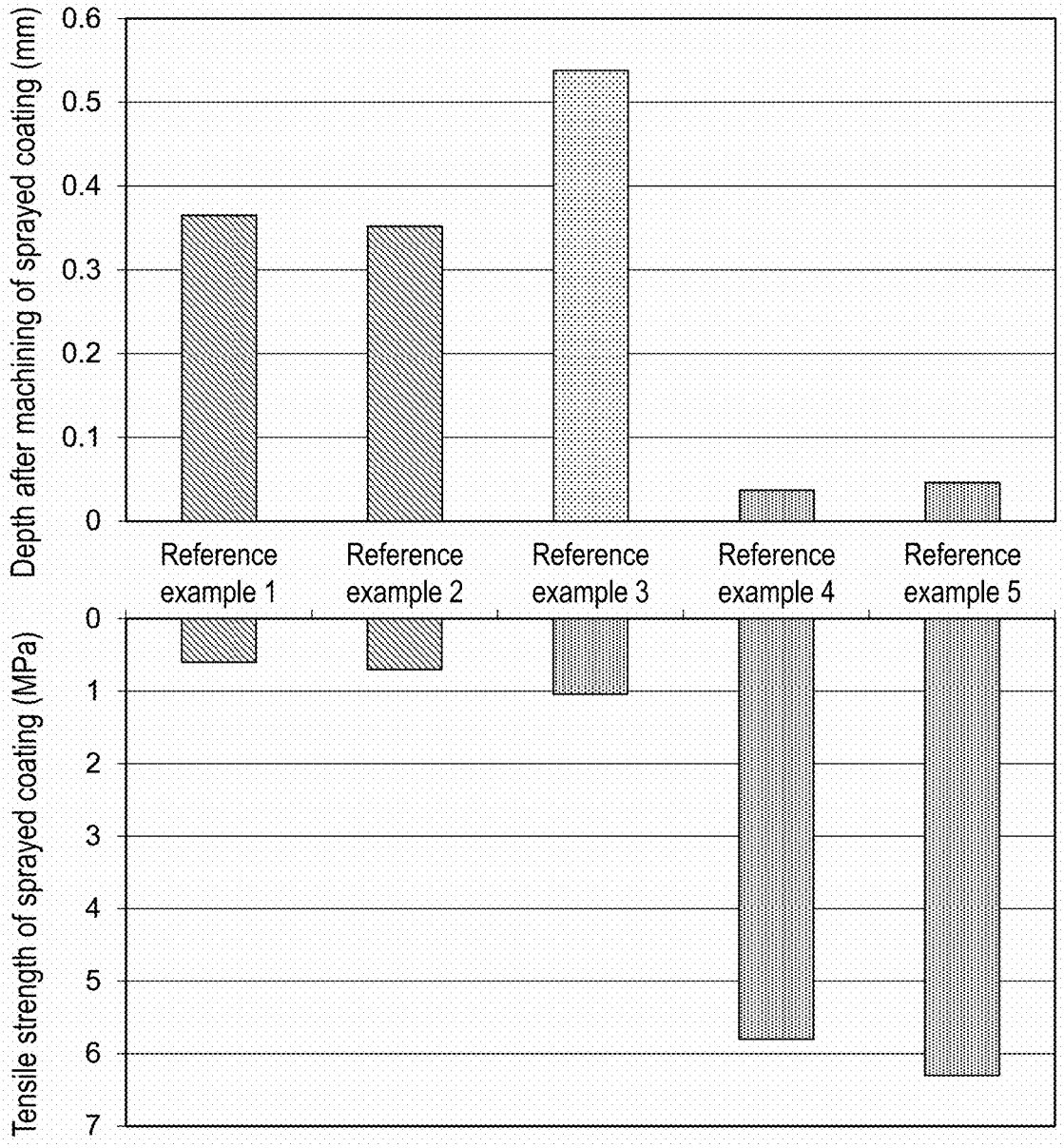
FIG. 19 shows graphs of the results of measuring the depths after the machining and the tensile strengths of the sprayed coatings of Reference Examples 1 to 5.

The aforementioned Machinability Test 1 was conducted on each of the sprayed test pieces of Reference Examples 1 to 5 under the condition of 800° C. Further, the tensile strength of the sprayed coating of each sprayed test piece was measured. The results are shown in FIG. 19. FIG. 19 shows graphs of the results of measuring the depths after the machining and the tensile strengths of the sprayed coatings of Reference Examples 1 to 5.

As shown in FIG. 19, the depths after the machining of the sprayed coatings of Reference Examples 4 and 5 deposited through plasma spraying are smaller than those of the sprayed coatings of Reference Examples 1 to 3 deposited through gas flame spraying. Further, the tensile strengths of the sprayed coatings of Reference Examples 4 and 5 deposited through plasma spraying are greater than those of the sprayed coatings of Reference Examples 1 to 3 deposited through gas flame spraying.

This is considered to be due to the reason that the temperature of a plasma flame of each of Reference Examples 4 and 5 was higher than the temperature of a gas flame of each of Reference Examples 1 to 3, and thus that strong bonds were formed between the NiCr-based alloy particles in the sprayed coating. Therefore, it is considered that depositing a sprayed coating using spraying powder through gas flame spraying can obtain a sprayed coating with higher machinability.

Examples 5 to 7: Optimum Particle Size of NiCr-Based Alloy Particles

Sprayed test pieces were produced as in Example 1. Examples 5 to 7 differ from Example 1 in that the particle sizes of NiCr-based alloy particles of spraying powder were set to less than 38 μm, over 150 μm, and 38 to 150 μm, respectively. Using the spraying powder of Examples 5 to 7, sprayed coatings were deposited as in Example 1 under the conditions of the feed rate of the spraying powder set to 110 g/minute and 60 g/minute.

Figure 20:
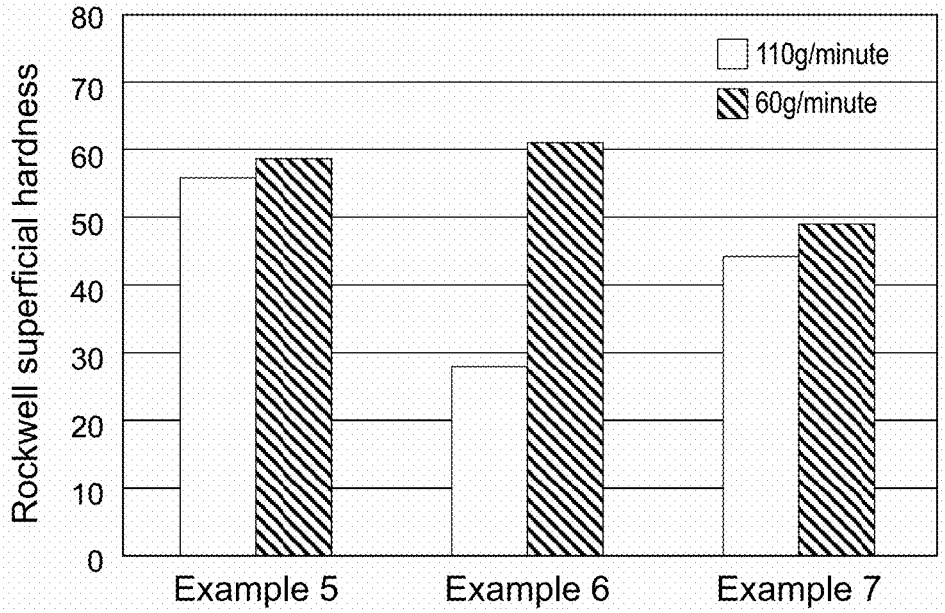
FIG. 20 shows graphs of the results of measuring the Rockwell superficial hardness (HR15Y) of the sprayed coatings of Examples 5 to 7 deposited with the feed rate of spraying powder set to 110 g/minute and 60 g/minute.

The Rockwell superficial hardness of each sprayed coating obtained was measured with a reference load of 3 kgf and a test load of 15 kgf. The results are shown in FIG. 20. FIG. 20 shows graphs of the results of measuring the Rockwell superficial hardness (HR15Y) of the sprayed coatings of Examples 5 to 7 deposited with the feed rate of spraying powder set to 110 g/minute and 60 g/minute.

Figure 21:
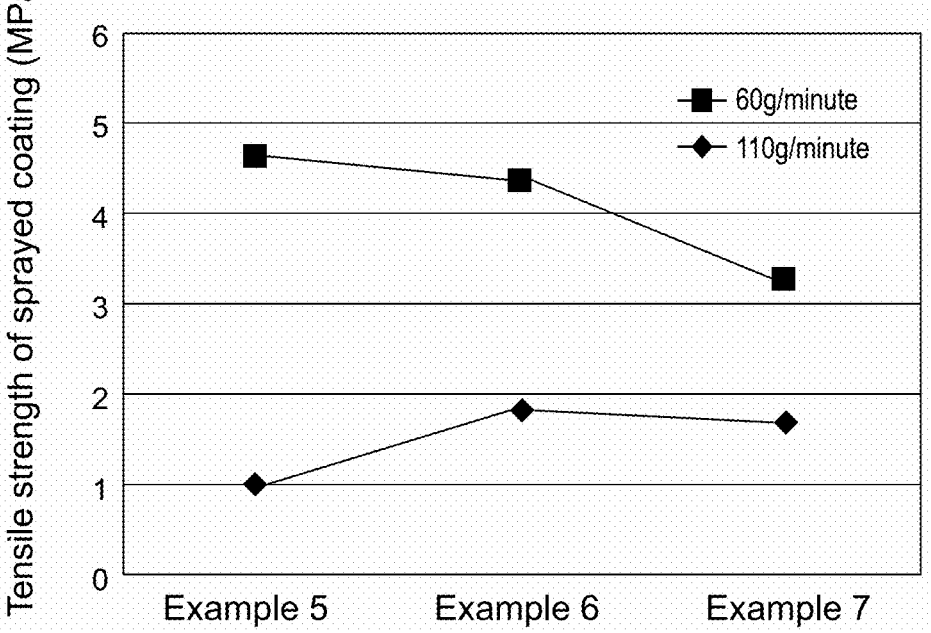
FIG. 21 shows graphs of the results of measuring the tensile strengths of the sprayed coatings of Examples 5 to 7 deposited with the feed rate of spraying powder set to 110 g/minute and 60 g/minute.

Further, the tensile strength of each sprayed coating obtained was measured. The results are shown in FIG. 21. FIG. 21 shows graphs of the results of measuring the tensile strengths of the sprayed coatings of Examples 5 to 7 deposited with the feed rate of spraying powder set to 110 g/minute and 60 g/minute.

As shown in FIG. 20, regarding Example 6, variations in the Rockwell superficial hardness of the sprayed coatings deposited with the feed rate of spraying powder set to 110 g/minute and 60 g/minute are larger than those of the other examples. Meanwhile, as shown in FIG. 21, regarding Example 5, variations in the tensile strength of the sprayed coatings deposited with the feed rate of spraying powder set to 110 g/minute and 60 g/minute are large. This is because the amount of energy received per powder particle from a gas flame differs depending on the particle size. Further, when a sprayed coating is deposited with the feed rate of spraying powder set to 110 g/minute, the amount of the spraying powder fed is larger than that when a sprayed coating is deposited with the feed rate of spraying powder set to 60 g/minute, and therefore, the temperature of the NiCr-based alloy particles is difficult to increase during spraying.

It should be noted that as shown in FIG. 21, regarding Example 5 with the feed rate of 60 g/minute, it is considered that since the particle size of the NiCr-based alloy particles was small and the feed amount thereof was small, the areas of contact between adjacent NiCr-based alloy particles became large, resulting in a sprayed coating with high tensile strength. Further, regarding Example 5 with the feed rate of 110 g/minute, it is considered that since the particle size of the NiCr-based alloy particles was small and the feed amount thereof was large, the areas of contact of the deposited spraying powder became small, resulting in a sprayed coating with low tensile strength.

As shown in FIG. 21, regarding Example 6 with the feed rate of 60 g/minute, it is considered that since the particle size of the NiCr-based alloy particles was large and the feed amount thereof was small, the NiCr-based alloy particles contacted one another while being entangled in a flattened state, resulting in a sprayed coating with high tensile strength. Further, regarding Example 6 with the feed rate of 110 g/minute, although the particle size of the NiCr-based alloy particles was large and the feed amount thereof was large, a sprayed coating with tensile strength in an appropriate range was obtained.

Meanwhile, as in Example 7, when spraying powder in which the particle size of NiCr-based alloy particles is in the range of 38 to 150 μm is used, it is considered that variations in the hardness and tensile strength of the resulting sprayed coatings can be stabilized regardless of the feed rate of the powder.

Although the embodiments of the present disclosure have been described in detail, specific configurations are not limited thereto, and any design changes that may occur within the spirit and scope of the present disclosure are all included in the present disclosure.

DESCRIPTION OF SYMBOLS

10 Spraying powder
10A Sprayed coating
11, 11A NiCr-based alloy particles
11B Oxide layer
12, 12A h-BN Particles
13, 13A Al particles
20 Substrate

What is claimed is:

1. A spraying powder for depositing a sprayed coating, comprising:

NiCr-based alloy particles and h-BN particles, wherein a NiCr-based alloy of the NiCr-based alloy particles contains 2 to 10 mass % of Si, a content of the h-BN particles in the spraying powder is 4 to 8 mass %, the NiCr-based alloy particles consist of Ni, Cr, and Si, and a melting point of the NiCr-based alloy particles is 940 to 1200 degrees C.

* * * * *